US011541974B2

(12) United States Patent
Colborn

(10) Patent No.: US 11,541,974 B2
(45) Date of Patent: Jan. 3, 2023

(54) LOW PRESSURE RESPIRATION GAS DELIVERY METHOD

(71) Applicant: John Colborn, Taylor Lake Village, TX (US)

(72) Inventor: John Colborn, Taylor Lake Village, TX (US)

(73) Assignee: Setaysha Technical Solutions, LLC, Magnolia, TX (US)

( * ) Notice: Subject to any disclaimer, the term of this patent is extended or adjusted under 35 U.S.C. 154(b) by 299 days.

(21) Appl. No.: 16/768,644

(22) PCT Filed: Nov. 30, 2018

(86) PCT No.: PCT/US2018/063440
§ 371 (c)(1),
(2) Date: May 29, 2020

(87) PCT Pub. No.: WO2019/109014
PCT Pub. Date: Jun. 6, 2019

(65) Prior Publication Data

US 2021/0171168 A1 Jun. 10, 2021

Related U.S. Application Data

(60) Provisional application No. 62/593,870, filed on Dec. 1, 2017.

(51) Int. Cl.

| | |
|---|---|
| ***B63C 11/14*** | (2006.01) |
| ***B63C 11/16*** | (2006.01) |
| ***B63C 11/20*** | (2006.01) |
| ***B63C 11/22*** | (2006.01) |

(52) U.S. Cl.
CPC ..... *B63C 11/202* (2013.01); *B63C 11/14* (2013.01); *B63C 11/16* (2013.01); *B63C 11/2209* (2013.01)

(58) Field of Classification Search
CPC ... B63C 11/14; B63C 11/16; B63C 2011/165; B63C 11/202; B63C 11/2209
USPC ..... 405/185, 187; 128/201.23, 201.27, 128/201.28, 204.18, 204.26; 114/315
See application file for complete search history.

(56) References Cited

U.S. PATENT DOCUMENTS

| | | | |
|---|---|---|---|
| 3,467,091 | A | 9/1969 | Aragona |
| 3,907,236 | A | 9/1975 | Sims, Jr. |
| 3,965,892 | A | 6/1976 | Colston et al. |
| 4,022,201 | A | 5/1977 | Diggs |

(Continued)

FOREIGN PATENT DOCUMENTS

| | | | |
|---|---|---|---|
| CN | 109069781 | A | 12/2018 |
| DE | 19741424 | A1 | 5/1999 |

(Continued)

OTHER PUBLICATIONS

European Extended Search Report dated Jan. 31, 2019, European Patent Application No. 17757094.2 filed Sep. 24, 2018.

(Continued)

*Primary Examiner* — Sunil Singh
(74) *Attorney, Agent, or Firm* — Timothy L. Scott, Esq.

(57) ABSTRACT

A method and system to deliver to a submerged diver only that amount of breathing gas volume and pressure required at the diver's depth by controlling the actions of a valve in response to inhalation demand. A sensing unit detects diver respiration, and a logic unit controls a valve to deliver breathing gas to the diver from a breathing gas source via a tube.

16 Claims, 5 Drawing Sheets

(56) References Cited

U.S. PATENT DOCUMENTS

| | | | |
|---|---|---|---|
| 4,111,342 | A | 9/1978 | Kirby |
| 4,238,864 | A | 12/1980 | Kealoha |
| 4,245,632 | A | 1/1981 | Houston |
| 4,269,182 | A | 5/1981 | Le |
| 4,324,195 | A | 4/1982 | Cunningham et al. |
| 4,442,835 | A | 4/1984 | Carnegie |
| 4,472,082 | A | 9/1984 | Kroling |
| 4,674,493 | A | 6/1987 | Mitchell |
| 4,756,486 | A | 7/1988 | Campbell |
| 4,832,013 | A | 5/1989 | Hartdorn |
| 4,986,267 | A | 1/1991 | Doss |
| 5,067,920 | A | 11/1991 | Brisky |
| 5,173,067 | A | 12/1992 | Biba |
| 5,193,530 | A | 3/1993 | Gamow et al. |
| 5,297,545 | A | 3/1994 | Infante |
| 5,327,849 | A | 7/1994 | Miller |
| 5,351,681 | A | 10/1994 | Hudson |
| 5,373,925 | A | 12/1994 | Handford et al. |
| 5,392,808 | A | 2/1995 | Pierce |
| 5,471,976 | A | 2/1995 | Smith |
| 5,506,571 | A | 4/1996 | Dugan |
| 5,535,734 | A | 7/1996 | Lu et al. |
| 5,694,923 | A | 12/1997 | Hete et al. |
| 5,697,572 | A | 12/1997 | Salentine et al. |
| 5,924,416 | A | 7/1999 | Miller |
| 5,938,140 | A | 8/1999 | Fundak |
| 5,996,578 | A | 12/1999 | MacGregor |
| 6,299,581 | B1 | 10/2001 | Rapoport et al. |
| 6,817,359 | B2 | 11/2004 | Deas et al. |
| 7,011,089 | B2 | 3/2006 | Tokatlian |
| 7,159,528 | B1 | 1/2007 | Hilliker |
| 2004/0163642 | A1 | 8/2004 | Tokatlian |
| 2004/0168689 | A1 | 9/2004 | Kuriyama |
| 2004/0255943 | A1 | 12/2004 | Morris et al. |
| 2005/0268913 | A1 | 12/2005 | Morris et al. |
| 2007/0039617 | A1 | 1/2007 | Buhlmann et al. |
| 2008/0242162 | A1 | 10/2008 | Smith |
| 2009/0056718 | A1 | 3/2009 | Lindgren |
| 2010/0065055 | A1 | 3/2010 | Morris et al. |
| 2011/0308523 | A1 | 11/2011 | Morris et al. |

FOREIGN PATENT DOCUMENTS

| | | | |
|---|---|---|---|
| EP | 0341085 | A1 | 11/1989 |
| EP | 0437948 | A1 | 7/1991 |
| EP | 3419709 | A1 | 1/2019 |
| EP | 3419709 | B1 | 4/2021 |
| GB | 2110566 | A | 6/1983 |
| WO | 1991001251 | A1 | 2/1991 |
| WO | 1997010991 | A1 | 3/1997 |
| WO | 1997012175 | A1 | 4/1997 |
| WO | 2016094944 | A1 | 6/2016 |
| WO | 2017147109 | A1 | 8/2017 |
| WO | 2019109014 | A1 | 6/2019 |

OTHER PUBLICATIONS

International Search Report dated May 16, 2017, International Patent Application No. PCT/US2017/018802 filed Feb. 22, 2017.

International Written Opinion dated May 16, 2017, International Patent Application No. PCT/US2017/018802 filed Feb. 22, 2017.

International Preliminary Report on Patentability dated Aug. 28, 2018, International Patent Application No. PCT/US2017/018802 filed Feb. 22, 2017.

Air Buddy, "Dive With The Ease Of Snorkeling Into The Fascinating World Underwater", found at: https://www.airbuddy.net/.

Third Lung, "Brownie's Third Lung", found at: https://www.browniedive.com/store/p36/Sea_Lion_-_3_Hour_Floating_Hookah_Diving_System.html.

Diveandfish, "Powerdive Power Snorkel", found at: http://www.diveandfish.com.au/special/powerdive-power-snorkel.html.

Keene Engineering, "Keene HydroAir Battery Powered Floating Compressor Diving System", found at: https://keeneeng.com/2016/09/27/keene-hydroair-12-volt-hookah-system/.

Colborn, John, "Low Pressure Surface Supplied Air System and Method," U.S. Appl. No. 62/299,199, filed Feb. 24, 2016.

Communication Pursuant to Article 94(3) EPC dated Jul. 23, 2019, European Patent Application No. 17757094.2 filed Sep. 24, 2018.

International Search Report dated Jun. 6, 2019, International Patent Application No. PCT/US2018/0063440 filed Nov. 30, 2018.

Colborn, John, "Low Pressure Respiration Gas Delivery Method," U.S. Appl. No. 62/593,870, filed Dec. 1, 2017.

Communication under Rule 71(3) EPC dated Sep. 7, 2020, European Patent Application No. 17757094.2 filed Feb. 22, 2017.

Communication pursuant to Article 94(3) EPC dated Dec. 20, 2019, European Application No. 17757094.2 filed Feb. 22, 2017.

Written Opinion dated Jun. 6, 2019, International Patent Application No. PCT/US2018/0063440 filed Nov. 30, 2018.

International Preliminary Report on Patentability dated Jun. 2, 2020, International Patent Application No. PCT/US2018/0063440 filed Nov. 30, 2018.

Office Action dated Feb. 22, 2021, Australian Patent Application No. 2017222445 filed Feb. 22, 2017.

LOW PRESSURE RESPIRATION GAS DELIVERY METHOD

PRIORITY

CROSS-REFERENCE TO RELATED APPLICATIONS

The present application claims priority to and is the National Stage of International Application No. PCT/US2018/063440 filed Nov. 30, 2018 which claims priority to U.S. Provisional Application Ser. No. 62/593,870 filed Dec. 1, 2017 the disclosure of both which are incorporated herein by reference.

BACKGROUND

The present invention is in the technical field of breathable gas delivery. More particularly, the present invention is in the technical field of delivering breathing gases used for underwater activities.

Surface Supplied Air, or "hookah" diving is a current means for underwater breathing akin to scuba diving, but the diver is tethered to the surface via a tube which delivers the breathing gases from a floating pump or pressurized tank. The current state of the art breathing methods for these technologies involve pressurizing the breathing gases at the surface using pumps that deliver gases in the range of 125 psi through a tube extending to the diver's depth, and from the tube to a mouthpiece-mounted pressure regulator, with a large pressure drop through a regulator inlet valve to the diver's local pressure at the point of delivery to the diver's mouth. However, at shallow depths the local pressure of the diver is much less than the intermediate pressure, in which case a great deal of the energy initially expended to compress the breathing gases to, e.g., 125 psi is largely wasted. For example, at a 30-feet water depth the diver's local pressure above atmospheric pressure is only 13 psi.

An exemplary prior art means of controlling the action and thus the energy consumption of a pump to compress air to high pressure, and to maintain a pressure in a tank or high-pressure supply lines between an upper threshold pressure and a lower threshold pressure, is illustrated by Carmichael et al. (US20110308523 A1). One or more divers may use the high-pressure air (e.g., in a tank or high-pressure tubes) via conventional second-stage scuba-type regulators and pressure-drop valves to reduce the (high) air pressure to the (lower) local pressure of the submerged diver. To avoid operating the pump continuously, a sensor is used to control the pressure in the reservoir between an upper and a lower pressure threshold. The sensor and associated logic causes the pump to turn on only when the air in the high-pressure tank or tubes falls below the lower threshold pressure, at which point the pump turns on and continues to operate until the pressure in the tank/tubes rises to the upper threshold pressure, when the pump is turned off Although systems such as that of Carmichael et al. avoid the extremely high (e.g., ~3000 psi) pressures of scuba systems, the pressures involved are still relatively high, and typically even the lower pressure threshold is 50-75 psi or even higher.

The pump in systems such as that of Carmichael et al. is not operated in response to the breathing actions of the diver(s), but in response to the pressure in the tank/tubes falling below the predetermined lower threshold pressure. Although the falling pressure in the lines is caused by the diver(s) withdrawing compressed air from the high-pressure tank or tubes, the operation of the pump is independent of any actual breathing of the divers, unless and until such breathing causes the pressure in the tank/tubes to fall below the lower threshold pressure (e.g., 50-75 psi) necessary to trigger the pump to turn on. Once the pump is turned on, it continues to operate independently of the breathing of the diver(s) until the upper threshold pressure is reached.

Hookah systems such as the Carmichael et al. system waste a great deal of energy but do have several desirable characteristics. Most importantly, the system is very reliable, in part because the pressure differential between the breathing gas supply source (e.g., a tank or compressed gas in tubes/lines/hoses) and the pressure necessary to deliver breathable gas at the diver's local pressure is relatively high (typically >50 psi differential pressure). This pressure differential, referred to herein as the overhead pressure, results in rapid and high-volume air delivery when the diver inhales and causes the pressure letdown valve in the regulator assembly to open. Because the high reliability is achieved by using a large overhead pressure, scuba and hookah systems also must be designed to withstand the relatively high pressures involved. Hookah systems typically involve a pressure tank and/or pressure hoses rated to 250 psi or greater to accommodate the 125-150 psi storage pressures used. Such high-pressure components add additional expense, bulk, rigidity, and weight, making many such systems extremely cumbersome and difficult to use.

In systems such as the Carmichael et al. system, the pressure of breathing gas in an air supply reservoir (e.g., a tank or high-pressure tubes) is sensed by means of an actuating element. The force of the breathing gas in the supply tube is opposed by, e.g., a biasing spring or opposing magnets. The sensory element is actuated when the reservoir pressure falls below a predetermined spring biasing force equivalent to the predetermined lower threshold pressure. The pump is then turned on until the pressure in the tank/tubes reaches the upper threshold pressure (e.g., 125-150 psi). Although such systems do save some energy_since the pump does not operate while the reservoir pressure is falling from the upper to the lower pressure threshold, they still waste energy by compressing air to pressures far in excess of that actually required by the diver(s).

High pressures are utilized in hookah equipment because the mouthpiece-mounted regulators used in hookah diving are adapted from scuba designs, which utilize even higher pressures in the body-worn scuba tanks (~3000 psi). To pressurize 1 cubic-foot of air from atmospheric pressure to 125 psi requires 386 Joules of energy. In comparison, pressurizing 1 cubic-foot of air from atmospheric pressure to 13 psi requires only 40J; or ~10% of the energy. Hookah systems, which do not sense diver breathing, use conventional scuba-type pressure reduction valves to lower the pressure from the storage reservoir (e.g., a tank or high-pressure lines/hoses acting as a reservoir) pressure to the local pressure at the diver's depth.

The high overhead pressures used in scuba and hookah systems discussed above represents wasted energy, and manufacturers of hookah systems have endeavored to modify conventional second-stage scuba-type regulators to operate at lower pressures. More recently, hookah systems have been developed using specially prepared hookah mouthpiece regulators to operate in the 50-75 psi range. This is typically accomplished by modifying springs within the mouthpiece regulator to re-balance valve opening forces given the reduced pressures of hookah systems compared to scuba systems. While this represents a significant efficiency improvement over typical SCUBA mouthpiece regulators operating at pressures of, e.g., 125 psi, the 50-75 psi pressures of these hookah systems still represent a significant energy waste for relatively shallow diving depths of, e.g., 10-30 ft, where diver inhalation must overcome only 4.5-13 psi of prevailing water pressures at those respective depths. As noted, the difference between the pressure of the breathing gas supply source (e.g., the outlet pressure of a pump of the pressure in a tank or high-pressure hose reservoir) and the pressure that must be supplied at the diver's regulator to ensure adequate breathing gas during inspiration (functionally about 1-2 psi above the pressure of the diver's local external environment) is referred to herein as the overhead pressure. For example, if breathing gases are delivered at 75 psi to the regulator of a diver at 10 ft depth (4.5 psi local water pressure +1 psi), the overhead pressure is 69.5 psi. The overhead pressure is indicative of wasted energy, and the present disclosure provides systems and methods to minimize overhead pressures and thus minimize wasted energy.

Many commercial scuba and hookah implementations regulate breathing air by the movement of a flexible membrane separating the diver's breathing pathway from the local water environment. As the diver inhales, the air pressure in the regulator chamber falls slightly below that of the water pressure in the local environment (typically by about 1-inch of water (0.036 psi)). The decrease in pressure on one side of the membrane causes the membrane to move, and the membrane movement pushes on the long end of a fulcrumed lever, which often has a 10:1 or greater mechanical advantage. The short side of the lever acts upon a mechanical valve which is the breathing air supply valve. This valve must be pre-loaded (e.g., with a spring) at a biasing force sufficient to keep the valve closed until the diver inhalation dictates opening. Typically the spring needs to act against the (50-75 psi) breathing air supply pressure on the other side of the valve as well. Because the amount of force that is generated from the negative pressure of the divers' inhalation is miniscule, a large-mechanical-advantage lever must be used to actuate the air supply valve. Because a large mechanical advantage is used, the amount of displacement achievable to move the valve is also very small (e.g., 0.030-inch). Because the valve opening is small, in order to supply the needed breathing air flow rate (exceeding 2 liters per second) across the small valve opening, hookah and scuba systems must operate with pressure overheads of e.g. 70 psi or more.

A further difficulty in commercial scuba and hookah implementations to regulate the diver's breathing air supply is the difficult balance that must be achieved between the spring force pre-load on one side of the air supply valve and the air supply pressure on the other side of the valve to both adequately provide air flow on demand as the diver inhales and avoid free flow of air through the regulator when the diver is not inhaling. All of these competing forces must be balanced and optimized, and some are inevitably compromised during the mechanical assembly and any adjustment of the breathing air regulator, with any incorrect adjustment potentially causing a dangerous malfunction. Because of the difficulty of balancing the spring forces in scuba and hookah regulators, specialized equipment and training are typically required to service and adjust their components. In addition, reliability is a challenge, and the user and manufacturer must make compromises between the goals of ease of breathing, durability, propensity to free flow when in different orientations, and propensity to free flow when the regulator is not in the diver's mouth.

Embodiments of the present disclosure are significantly different from hookah systems, and provide systems and methods for sensing the breathing of a submerged diver and delivering the volume of breathing gas required by the diver_in response to one or more of the inhalation and/or exhalation, but at a significantly reduced system pressure with correspondingly reduced energy requirements. The benefits of meeting the diver's need with less pressure is that the pumping system can be designed to be lighter, less complex, and with less energy required. In one embodiment, the present disclosure provides systems and methods for sensing the breathing of a diver and delivering air with little or no overhead pressure. In one embodiment, the overhead pressure may be 5 psi or less, such as 4 psi, 3 psi, 2 psi or 1 psi or even less. All of these can facilitate lowering cost, lowering system weight, improving portability, and/or extending pump run-time for any given energy supply.

A system achieving these objectives for shallow diver depths (~ten feet or less) is published in International Application No. WO 2017/147109A1 (hereinafter the '109 application) in the name of the present applicant. The '109 application discloses a system having a floating pump to supply air to a submerged diver in response to sensed inspiration and/or expiration of the diver. The pump delivers breathing gases (e.g., air from the atmosphere) at a pressure that is only at or slightly above the local pressure of the diver (e.g., by ~1-2 psi), which at ten feet is only 4.3 psi. Because the pressures are modest and there is little or no overhead pressure in system of the '109 application, no letdown valve is used and the pump only develops the pressure necessary to deliver the breathable gas at the diver's depth (i.e., the pressure of the diver's local environment at the particular diving depth plus about 1-2 psi to overcome frictional losses in the tube/hose and regulator), greatly reducing the energy required by the pump compared to scuba or hookah systems. In addition, because the pump may be turned off or operated at a significantly reduced speed (half of less of the pump speed during inspiration) further energy savings and reduced pump wear may be achieved.

Although the system disclosed in the '109 application is adequate to reliably and efficiently supply air to divers at shallow depths of 10 feet or less, as diving depth increases beyond 10 feet the reliability of system decreases because of the increasing pump load and the increasingly variability in that load as the diver breathes. In the '109 application system, breathing gas is delivered to the diver on demand in response to the diver's inhalations, with no letdown valve between the pump and the diver's regulator. Accordingly, the pump must develop an outlet pressure equal to the local pressure each time the diver inhales, plus a small increment (1-2 psi or even less in some cases) to overcome frictional losses in the tubing line coupling the pump to the diver's regulator. For shallow depths of 10 feet or less, the modest 4.3 psi outlet pressure required to equal the diver's local depth may be achieved fairly easily, although at depths near 10 feet the pump load is significantly higher than that near the surface. In contrast, at a depth of 30 feet the necessity for the pump to compress the air in the tube from atmospheric pressure at the inlet to 13.0 psi at the outlet presents a much more difficult challenge (nearly a tripling in pressure), not only in the outlet pressure that must be developed but in the short time period available after the diver begins to inhale for the pump to develop the required outlet pressure. If air is not delivered to the diver within about 100-500 msec after inhalation begins, the diver may notice the delay in breathing gas delivery from the pump, which may negatively impact the diving experience, particularly if the diver is engaging in swimming or other exertional effort. Longer delays in breathing gas delivery may even cause the diver to panic, which becomes increasingly dangerous as the depth—and risk of decompression sickness (i.e., the bends)—increases.

In an energy-optimized on demand underwater breathing system, the system would supply only the pressure and volume of breathing gas needed by the diver, and would not cause the pump to waste energy by generating pressure or gas volume greater than needed for respiration. One technical challenge to fulfill these competing goals results from the fact that diver depth varies as a normal part of diving. In many cases the diver's local pressures may vary by thousands of percent during the course of a single dive—e.g., from fractions of a psi near the surface to about 30 psi at 60 feet. Furthermore, diver respiration patterns and volumes cannot be predicted.

The '109 application provides, in one embodiment, an energy-optimized system for use at relatively shallow diving depths with a sensor to discern the pressure changes associated with diver respiration, a breathable air determination unit to determine when breathable gas is needed by the diver based on pressure changes associated with diver respiration, and a pump controller to control the operation of a pump to provide breathable gas to a diver. The system provides the breathing gas more or less instantaneously with diver respiration cycles and local pressure. However, in addition to being limited to relatively shallow depths, systems disclosed in the '109 application are limited to a single diver because the actions of the pump are synchronized to the breathing patterns of the diver, and because multiple divers will not have breathing patterns exactly synchronized. The single-diver limitation is in contrast to commercial hookah dive systems which allow multiple divers—typically two-to-four divers—to be supplied breathing air via a single breathing gas supply (e.g., pump/reservoir). When two or more divers will be diving together, it is economically advantageous that the investment in the breathing gas supply system (e.g., pump and supporting hardware) can be utilized to supply air for multiple divers compared to the scenario where each diver is required to purchase a separate pump and supporting hardware.

A further limitation of the '109 application is that, in some embodiments, the pump stops during exhalation, and must start more or less instantaneously upon inhalation. Starting the pump more or less instantaneously at unpredictable times and under the load of existing backpressure in the air supply tube necessitates high starting power for the pump, much more than if the pump continued running albeit at a slower speed. While starting loads can be overcome by appropriate design choices and are of little impact at shallow depths/low pressures, supplying divers to deeper depths increases the complexity and cost necessitated in the pump/motor/power source design.

A further limitation of the '109 application is that the system allows for no provision of buffer capacity, i.e., there is no reservoir of extra breathing gas in the system, in contrast with hookah systems which use either a tank or high-pressure air in high-pressure hoses that function as a reservoir. While this is of little impact at shallow depths, the utility of having a buffer breathing gas supply increases with diver depth, as one or several breaths of air availability in the event of pump stoppage can afford the diver sufficient air to conduct an ascent at safe speeds despite operations at deeper depths.

Systems and methods of the present invention provide improvements in on-demand breathing gas delivery systems that are similar to those of the '109 application, but which allow for reliable breathing gas delivery at depths beyond those achievable with the system disclosed therein. In particular, systems of the present invention provide for the use of a regulator gas control valve 27 that avoids high pressure swings in at least a portion of the breathing gas delivery tube 30 between the outlet of the pump 28 and the diver regulator 42. Also provided is a regulator gas control valve 27 capable of rapid and complete opening to deliver breathing gas from the pump 28 to the diver with minimal loss of energy and/or pressure.

SUMMARY OF THE INVENTION

In one embodiment, the present invention comprises a method of providing breathable gas to one or more submerged divers in a system comprising a pump for providing the breathable gas to the one or more submerged divers, wherein each of the one or more submerged divers is provided with a breathable gas regulator comprising an inlet and an outlet and having a regulator pressure sensor coupled thereto, a powered regulator gas control valve, and a tube coupling the breathable gas regulator to the pump, the method comprising: for each of said one or more divers: sensing pressure changes in the regulator associated with diver respiration using the regulator pressure sensor; determining at least one of diver inhalation and diver exhalation based on said sensing; operating the powered regulator gas control valve to allow breathable gas to flow from the pump to the breathable gas regulator during at least a portion of diver inhalation, and to prevent the flow of breathable gas from the pump to the breathable gas regulator during at least a portion of diver exhalation; determining a pressure difference across the powered regulator gas control valve; and providing a pump control signal based on the pressure difference across the powered regulator gas control valve; and operating the pump based on the pump control signals for each of said one or more divers.

In one embodiment, the present invention comprises a method of providing breathable gas to one or more submerged divers in a system comprising a pump for providing breathable gas to the one or more submerged divers, and a diving subsystem for each of the one or more divers, the diving subsystem comprising a) a breathable gas regulator having an inlet, an outlet, a regulator chamber, and a regulator pressure sensor, b) a powered regulator gas control valve located between the pump and the regulator chamber, and c) a tube coupling the pump to the regulator, the method comprising: for each of the diving subsystems: sensing pressure changes in the regulator associated with diver respiration using the regulator pressure sensor; determining, based on the sensing, one of a need for air by the diver and the absence of a need for air by the diver; operating the powered regulator gas control valve by opening the valve to allow breathable gas to flow from the pump to the breathable gas regulator in response to a determination of a need for air by the diver, and by closing the valve to prevent the flow of breathable gas from the pump to the breathable gas regulator in response to a determination of the absence of a need for air by the diver; determining a pressure difference across the powered regulator gas control valve; and providing a pump control signal based on the pressure difference across the powered regulator gas control valve; and operating the pump, based on the pump control signals for each of the one or more divers, to provide breathing gas at a pump outlet pressure of no more than 5 psi above the highest local pressure of the one or more divers.

In one embodiment, the present invention comprises a system to provide breathable gases to a submerged diver, comprising: a pump having a pump inlet fluidly coupled to a source of breathable gases at a first pressure and a pump outlet providing pressurized breathable gases to a submerged diver at a second pressure greater than the first pressure; a breathable gas regulator assembly including a regulator chamber having a regulator inlet, a regulator outlet, a mouthpiece fluidly coupled to the regulator chamber and having a breathing aperture, an articulating element, and a regulator pressure sensor to provide a regulator pressure signal indicative of whether breathable gases are needed by the diver based on movement of the articulating element; a tube coupling the pump outlet to the regulator inlet; a powered regulator gas control valve located between the pump outlet and the regulator chamber; a differential pressure sensor assembly to sense a pressure difference across the powered regulator gas control valve and to provide a differential pressure signal indicative of the pressure difference across the powered regulator gas control valve; and at least one logic unit to control the operation of the pump based on the differential pressure signal and the operation of the powered regulator gas control valve based on the regulator pressure signal.

In one embodiment, the present invention comprises a system to provide breathable air to a submerged diver, including: a floating pump assembly comprising: a buoyant element, a pump coupled to said buoyant element, said pump having a pump inlet fluidly coupled to the atmosphere, and a pump outlet, said pump operating to provide pressurized breathable air at the pump outlet at a pressure greater than atmospheric pressure; at least two breathable gas regulator assemblies, each assembly being usable by a single diver and including: a regulator chamber having a regulator inlet and a regulator outlet, a mouthpiece fluidly coupled to the regulator chamber and having a breathing aperture, and a regulator pressure sensor to sense pressure changes within the regulator chamber associated with diver inhalation and exhalation and to provide a regulator pressure signal indicative of the pressure changes; a powered regulator gas control valve located between the pump outlet and the regulator chamber; and a differential pressure sensor assembly to provide a differential pressure signal indicative of the pressure difference across the powered regulator gas control valve; tubing coupling the pump outlet to each of the at least two breathable gas regulator assemblies; and at least one logic unit to control the operation of the pump in providing breathable air to the diver based on the pressure differential signals of the at least two breathable gas regulator assemblies, and to control the operation of each powered regulator gas control valve based on the associated regulator pressure signal.

In one embodiment, the present invention comprises a regulator assembly for a submerged diver, comprising: a regulator body comprising: a regulator chamber having a regulator inlet and a regulator outlet; a mouthpiece fluidly coupled to the regulator chamber and having a breathing aperture through which the diver inhales and exhales; a regulator pressure sensor to sense pressure changes within the regulator chamber associated with diver inhalation and exhalation and to provide a regulator pressure signal indicative of the pressure changes; and a powered regulator gas control valve coupled to the regulator inlet.

In one embodiment, the present invention comprises a method of providing breathable gas to one or more submerged divers in a system comprising a pump for providing breathable gas to the one or more submerged divers, and a diving subsystem for each of the one or more divers, the diving subsystem comprising a) a breathable gas regulator having an inlet, an outlet, a regulator chamber, and a regulator pressure sensor, b) a powered regulator gas control valve located between the pump and the regulator chamber, and c) a tube coupling the pump to the regulator, the method comprising: for each of the diving subsystems: sensing pressure changes in the regulator associated with diver respiration using the regulator pressure sensor; determining, based on the sensing, one of a need for air by the diver and the absence of a need for air by the diver; operating the powered regulator gas control valve by opening the valve to allow breathable gas to flow from the pump to the breathable gas regulator in response to a determination of a need for air by the diver, and by closing the valve to prevent the flow of breathable gas from the pump to the breathable gas regulator in response to a determination of the absence of a need for air by the diver; determining a pressure difference across the powered regulator gas control valve; and providing a pump control signal based on the pressure difference across the powered regulator gas control valve; and operating the pump, based on the pump control signals for each of the one or more divers, to provide breathing gas at a pump outlet pressure of no more than 20 psi above the highest local pressure of the one or more divers.

In one embodiment, the present invention comprises a system to provide breathable gases to at least one submerged diver, comprising: a pump having a pump inlet fluidly coupled to a source of breathable gases at a first pressure and a pump outlet providing pressurized breathable gases to a submerged diver at a second pressure greater than the first pressure; at least one breathable gas regulator assembly including a regulator chamber having a regulator inlet, a regulator outlet, a mouthpiece fluidly coupled to the regulator chamber and having a breathing aperture; a pressure sensor for sensing a local water pressure of the diver and providing a pressure signal indicative of the local water pressure; a breathable gases reservoir coupled to the pump outlet and the at least one breathable gas regulator assembly, from which the at least one submerged diver breathes breathable gases; a tube coupling the pump outlet to the regulator inlet; and at least one logic unit to control the operation of the pump based on the pressure signal.

In one embodiment, the present invention comprises a method to provide breathable gases to one or more submerged divers in a system comprising a pump for providing breathable gas to the one or more submerged divers, a pressurized reservoir for receiving compressed breathable gas from the pump, at least one breathable gas regulator coupled to the pressurized reservoir and having an inlet and an outlet coupled to a regulator chamber, and at least one pressure sensor for sensing a local water pressure of each of the one or more divers, the method comprising: sensing a local water pressure of each of the one or more divers and providing a local water pressure signal for each of the one or more divers indicative of the local water pressure of the diver; and operating the pump to pump to maintain a pressure in the reservoir above a threshold pressure, wherein the threshold pressure value is based on the local water pressure signals.

BRIEF DESCRIPTION OF THE DRAWINGS

Illustrative embodiments of the invention are described herein. In the interest of clarity, not all features of an actual implementation are described in this specification. In the development of any such actual embodiment, numerous implementation-specific decisions must be made to achieve the design-specific goals, which will vary from one implementation to another. It will be appreciated that such a development effort, while possibly complex and time-consuming, would nevertheless be a routine undertaking for persons of ordinary skill in the art having the benefit of this disclosure.

Certain terms are used throughout the following description and refer to particular system components. As one skilled in the art will appreciate, components may be referred to by different names. This document does not intend to distinguish between components that differ in name but not function.

DETAILED DESCRIPTION OF THE INVENTION

Figure 1:
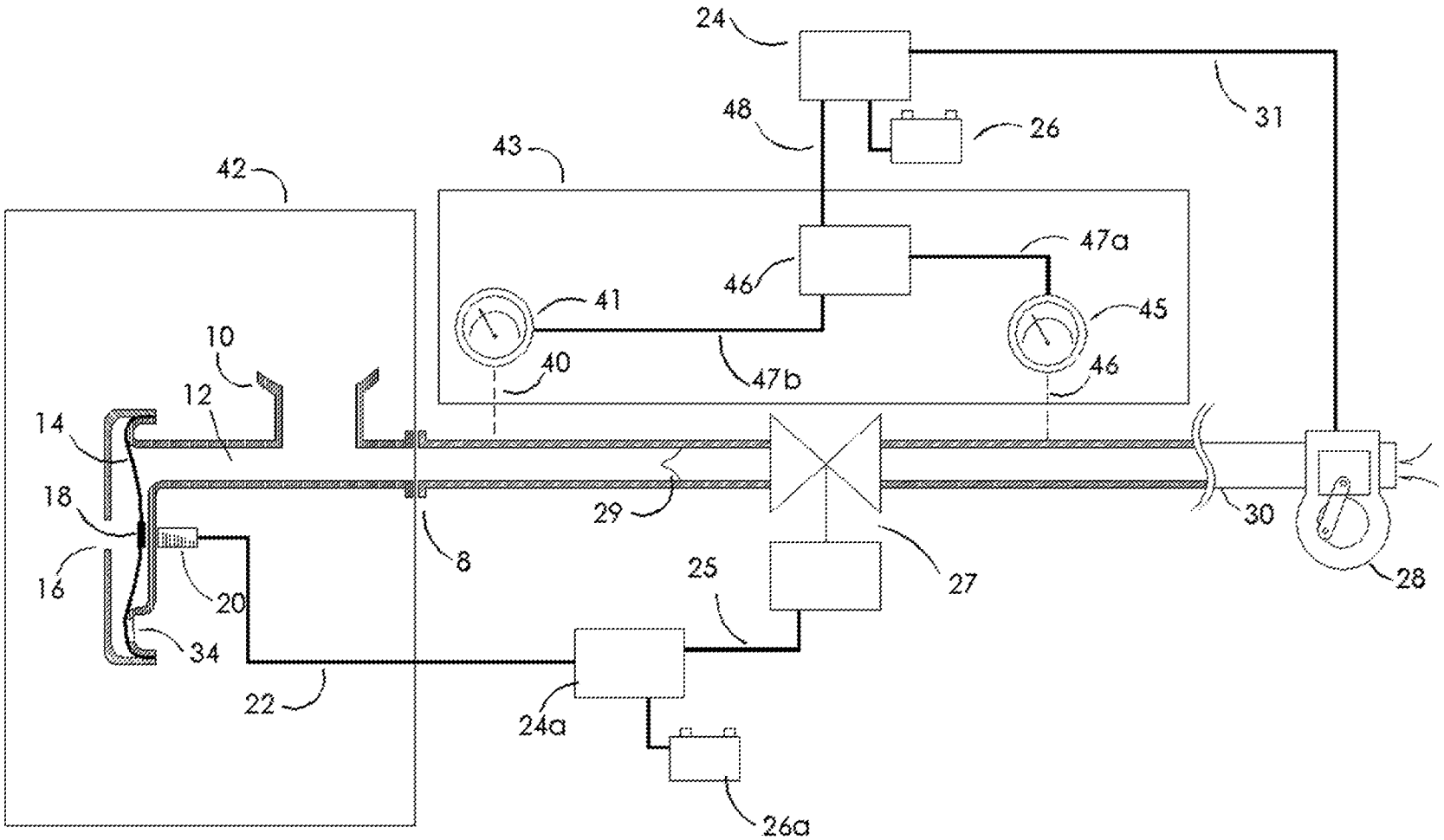
FIG. 1 is a functional system diagram of an embodiment of a diving system according to the present disclosure.

In one aspect, embodiments of the present invention overcome limitations of commercially available scuba and hookah breathing regulators as well as limitations of the '109 application. The present invention utilizes a regulator pressure sensor to measure the effects of a diver's breathing patterns within the local water pressure environment. The regulator sensor output is monitored by a logic unit that controls the action of a regulator gas control valve to supply breathing gas to the diver. Because the valve is actuated by forces and energy (e.g., electrical power) which are not limited by the amount of work or energy generated from the diver's breathing forces, the action of the valve can be controlled with more power than that possible with mechanically-actuated valves which rely on mouth pressures alone.

As used herein, the term "powered regulator gas control valve" or "powered valve" refers to a valve for regulating the flow of air from a pump to a diver's regulator that is actuated by energy not supplied by the diver. This may include, in various embodiments, electrical, optical, pneumatic, magnetic, or other sources of power. In addition, the opening position of can be controlled more precisely than prior art scuba and hookah regulator valves which operate using a very small opening. For example, some embodiments of the present invention cause the breathing air supply valve to open to a position in which the valve aperture through which the breathing gases flow from the pump to the diver has an area equal to that of the supply tube from the pump, and do so very rapidly (i.e., <=500 msec, preferably <=100 msec), thus creating an opening for air flow to the diver which imposes practically no pressure drop across the valve and minimizing the pressure that must be developed by the pump. In general, suitable powered regulator gas control valves for use in systems disclosed herein may be actuated to any of a plurality or range of positions from fully open to fully closed, such as half open, one-quarter open, three-quarters open, etc., as necessary to regulate the flow of air to the diver under a variety of conditions.

Embodiments of the present disclosure may utilize a logic unit to control the actions of the powered regulator gas control valve. In a software-controlled logic unit, decision logic, sensory, and control mechanisms are employed for appropriate management of valve opening and closing speed and position, and the delicate balance required of mechanical mechanisms and forces of existing scuba and/or hookah systems are obviated due to the software environment's deterministic nature, wider operating margins, ability to adapt via feedback control, and ability to execute multiple-path stimulus-response scenarios. Trimming may occur via software learning of limits upon power-up, thus eliminating the need for specialized training and equipment to trim a mechanical regulator typical for adjustment of scuba and hookah systems.

In one embodiment, the logic unit may cause breathing effort to be high in certain conditions (e.g., the system may require a significant amount of deflection of the breathing sensory element before opening the powered regulator gas control valve) to prevent unintended free-flow of air, which is the preferred condition when the regulator is not being used. The logic unit may subsequently change to a different operating condition when a pattern typical of breathing is encountered, e.g., requiring only a very light breathing effort or requiring only a small amount of deflection of the breathing sensor element, which reflects a small breathing force to open the powered regulator gas control valve to provide air to the diver, because that is the most comfortable system performance during diving.

In another embodiment, the logic unit incorporates a diver position sensor and adjusts breathing effort according to the diver's orientation. This is in contrast with mechanical regulators in which the designer must choose a single level of breathing effort that is a compromise among the various conflicting system constraints, which usually results in regulator free-flow in some orientations (usually upside-down), and difficult breathing effort in other positions (usually pointing head-down). Multi-path stimulus-response implementations allowed by the present disclosure are not readily implementable in mechanical regulators.

In another embodiment, the present disclosure provides a system in which breathing gas (e.g., air) having little or no overhead pressure can be provided to multiple divers from a single breathing gas supply source (e.g., pump or air compressor) because breathing gas delivery volume to each diver is controlled by a powered regulator gas control valve unique to each diver. By providing separate powered regulator gas control valves for each of a plurality of divers, the air supply for each diver is thereby decoupled from the instantaneous breathing gas volume delivery provided by the breathing gas supply source (e.g., pump or compressor), which is operated based on the needs of all divers considered together.

In embodiments for multiple divers, a notable functional limitation on absolute energy efficiency for a single pump supplying multiple divers lies in the requirement that the pump must develop an outlet pressure at least sufficient to supply the deepest diver. If, for example, one diver is at 30 feet, then a single pump supplying all divers must develop a pressure of at least 13 psi above atmospheric pressure (+1-2 psi to overcome frictional losses) even if another diver is operating at 10 ft and requires only about 4.5 psi above atmospheric pressure to ensure adequate breathing gas delivery to the diver. In this case, the pump is developing an overhead pressure with respect to the shallower diver of about 8.5 psi, which represents an energy waste. Despite this inherent limitation of single-pump systems, the present invention still outperforms present commercial implementations, which develop a large pressure overhead (e.g., 75-125 psi) for all divers, while also providing the ability to serve multiple divers from one air supply.

In some embodiments, the present invention allows for the pump to continue to run even in the event of diver breathing cessation or exhalation, because the breathing air flow is controlled by the actions of a powered regulator gas control valve and is thereby somewhat decoupled from the actions of the pump. Whether it is advantageous to maintain pumping momentum in order to utilize a smaller motor and power source vs the energy advantages of stopping the pump completely but with the need for larger motor and power supplies will be a matter of costing preference and design choice in view of the present disclosure.

In one embodiment, the logic unit, by taking into account each diver's depth, can cause the pump to develop a non-zero breathable gas overhead pressure that increases as the depth of the deepest diver increases, thereby providing a greater storage of air in the system as a safety backup. By providing a logic unit capable of operating the pump to provide a variable, non-zero overhead pressure which adjusts in accord with increasing risks as depth increases, but which is still far less than the overhead pressures of existing scuba and hookah systems, the present disclosure provides a system that significantly decreases the amount of overhead pressure (and thus wasted energy) in comparison to prior art systems, but also allows for a controlled, variable overpressure that allows more air to be stored in the system for diver safety at deeper diving depths.

In one embodiment, the present invention provides a means to sense the volume of breathing gases required, and control the volume of breathing gases delivered from an air source at low pressures. Whereas the current state of the art utilizes high system pressures (50-125 psi above atmospheric pressure), the present invention allows minimizing unused/wasted energy by delivering gases at the pressure required to supply the requested volume at the diver's water depth.

In many systems, a pressure sensor comprising one or more articulating elements is provided at the diver's regulator/mouthpiece, and is acted upon by the pressure of the environment and the pressure of the diver's lungs as the diver breathes. In such systems, the articulating parts move in response to the diver's pulling or pushing gases into/out of the regulator by inhaling and exhaling. The position of the articulating part is an indicator of the diver's actions of exhaling, breathing cessation, or inhaling. In alternative embodiments, an electronic pressure sensor may be used instead of articulating parts.

One or more sensors in the regulator detect pressure changes in the regulator associated with the diver's breathing. In one embodiment, the sensors generate a regulator pressure signal in response to the movement of the articulating part. Regardless of the type of sensor used, the one or more sensors provide a regulator pressure signal to a logic unit. In one embodiment, the sensor provides an electrical signal that is indicative of the instantaneous pressure within the regulator. The regulator pressure signal fluctuates as the diver exhales (higher pressure) and inhales (lower pressure).

In one embodiment, the logic unit interprets the sensor signal and generates a valve control signal to open or close a valve. More specifically, the logic unit interprets the regulator pressure signal to determine whether the diver is inhaling or exhaling. If the diver is inhaling, the diver needs air from an air source, and the logic generates a valve control signal to allow air flow to be delivered from the air source to the regulator and the diver's mouthpiece. Conversely, if the diver is exhaling or has ceased breathing, the diver does not need air from the air source, and the logic generates a valve control signal to prevent air from being delivered from the air source to the regulator and mouthpiece.

In one embodiment, the logic unit simply opens the valve to its maximum opening position in response to a determination that the diver is inhaling, and closes the valve if it determines that the diver is exhaling or has ceased breathing. In other embodiments, the logic unit may determine additional information regarding the diver's breathing, such as the breathing rate, volume, or whether the diver is in the early or late stages of inhalation or exhalation. In these embodiments, the valve control signal may be employed for other functions such as flow rate control in response to faster or slower inhalation rates, regulating the pressure of the breathing gas supplied to the diver, or enacting a fail-safe operating mode (i.e., causing the valve to open fully, and the pump to operate at a desired flow rate to ensure maximum air is available to the user). The logic unit also provides a pump control signal to control the actions of a pump (i.e., to cause the pump to turn on or off, or to control the speed of the pump so as to provide a desired flow rate of breathable air). In addition, the logic processor may also receive additional signals and perform additional functions such as battery state monitoring, system fault detection, initiating emergency actions (e.g., signaling for help), diver activity tracking, diver depth tracking, obtaining diver feedback, lighting control, photography control, or other functions achievable by a logic controller which will be evident to a person of ordinary skill in the art having the benefit of the present disclosure.

Embodiments of the present disclosure allow flow control of breathable air to a submerged diver to be achieved at significantly lower system pressures than typical commercial scuba and hookah "Second stage" regulators common in the art. scuba systems use a first stage regulator to reduce breathing gas pressure from very high tank pressures (up to 3000 psi) to an intermediate level (around 125-150 psi) in high-pressure tubing, and a second stage regulator to reduce pressure from the intermediate level to the diver's local underwater pressure, which may vary from 0 psi to several atmospheres, depending upon the depth of the diver. The second-stage regulator is typically located at the diver's mouth and includes a regulator chamber in which the mouthpiece is located, as well as an articulating pressure sensor that uses the very low pressure changes of the diver's breathing (typically on the order of 1 inch of water), to pneumatically actuate mechanical linkages which in turn control the opening or closing of a mechanically actuated valve to allow air into the regulator or to prevent air from traveling back to the air source during exhalation.

In order to utilize the relatively small forces afforded by normal breathing pressures, existing scuba and hookah designs utilize mechanical leverage to perform the actuations. Because of this, the resulting actuation distance of the mechanical valve opening is very small. This results in a very small movement of the valve and a correspondingly small-sized valve opening. While this is adequate for most scuba and hookah systems because of the relatively high pressure differential across the final stage regulator (i.e., between the pressure in the high-pressure tubing and the diver's regulator/mouthpiece), in systems of the present disclosure involving low air-source pressures (25 psi or less, usually 15 psi or less), the extremely small forces developed by the diver to open a valve may be insufficient to open the air control valve wide enough to deliver an adequate volume of breathing air to the diver. Normal respiration requires high instantaneous flow rates of at least 2 liters per second. In order to achieve high flow rates through small valve openings utilized in scuba and hookah systems, their regulator designs must necessarily use high pressures at the breathing gas supply.

In one embodiment, the present disclosure provides a powered regulator gas control valve capable of rapid and relatively large opening from a breathing gas (e.g., air) supply. Because systems of this disclosure do not use the miniscule forces afforded by normal respiration pressures to directly actuate a breathing gas supply valve, but instead use an auxiliary power source to actuate the breathing gas supply valve, they may employ valves with very large and fast-acting valve opening performance. Consequently, the systems and methods of the present disclosure avoid a significant pressure drop across the valve, even at high flow rates. Accordingly, the breathing gas supply pressure may be much lower; e.g. 13-15 psi for a diver at 30-feet water depth compared to the preceding designs described previously utilizing, for example, 125-150 psi. This represents a roughly 10× energy use performance advantage.

Referring now to the invention in more detail, FIG. 1 shows an embodiment of an on demand system for providing breathable gases (e.g., air) to a diver according to the present disclosure, with representative system elements illustrated. As used herein, "on demand" refers to a system in which a pump or compressor operates to pump air to the diver only in response to a determination that air is needed by the diver. A determination that the diver needs air may comprise, without limitation, determining that the diver is inhaling, or that the diver is exhaling and is expected to begin inhaling at a specific timepoint, or that the diver has completed an exhalation and has ceased breathing.

A regulator assembly 42 includes a mouthpiece or aperture 10, which may be a standard snorkel or scuba mouthpiece through which breathing occurs. The regulator assembly 42 includes a regulator having an inlet 8 and a chamber 12 through which breathable air is provided to the diver via mouthpiece 10 from a pump 28 through a tube 30 coupled to the inlet. Exhalation gases are expelled through a breathing gas outlet 34. In a preferred embodiment, the breathing aperture 10 is a standard scuba mouthpiece, but may be any aperture for delivering breathing air known in the art including but not limited to full face masks and helmets.

An articulating element 14, which may be a diaphragm or other moving element, is capable of movement within regulator chamber 12 in response to pressure and volume changes within the chamber 12 associated with the diver's breathing (e.g., inhalation and exhalation). The chamber 12 is sealed to separate the gases in the chamber from the surrounding environment (e.g., water for a submerged diver). This may be achieved, in a specific embodiment, by a flexible diaphragm sealed at the edges as illustrated in FIG. 1. A port 16 in the regulator assembly 42 is open to the diving environment, exposing one side of the articulating element 14 to the pressure local environment proximate to the diver's mouthpiece 10, while the other side of the articulating element 14 is exposed to the inhalation and exhalation gases in chamber 12. In a preferred embodiment, articulating element 14 is a silicone membrane fashioned in the form of a diaphragm, although other designs, including those with fewer or greater numbers of moving parts, are within the scope of the present disclosure.

Articulating element 14 incorporates a detection element 18 by which movement of the articulating element is detected by the regulator pressure sensor 20. The regulator pressure sensor 20 communicates a regulator pressure signal 22 to a logic unit 24*a*, typically via wire, although wireless transmission modes may be used in some embodiments. In a preferred embodiment, regulator pressure sensor 20 may comprise a Hall effect sensor, which is capable of detecting distance changes without contacting the detection element 18 and can therefore be completely encapsulated in a material that seals this electronic device from exposure to the surrounding water but without compromising distance or orientation sensing accuracy.

A powered regulator gas control valve 27, located between the pump 28 and the regulator chamber 12, is opened and closed in response to a valve control signal 25 from the logic unit 24*a*. The powered regulator gas control valve 27 may be located along tube 30 in one embodiment. In an alternate embodiment, the powered regulator gas control valve 27 may be located in or near the inlet 8 of regulator assembly 42. The logic unit 24*a* is also coupled to an energy source 26*a*. In one embodiment, the logic unit 24*a* processes the regulator pressure signal 22 to determine one or more breathing states such as inhalation, exhalation, cessation of breathing, initiation (start or onset) of inhalation or exhalation, or termination (end or stopping) of inhalation of exhalation to generate the valve control signal 25.

Valve control signal 25 is used to control the action of the powered regulator gas control valve 27, and may actuate the valve to any of a plurality of states, ranging from fully open to fully closed or any of a plurality of states therebetween. In various embodiments, logic unit 24*a* may also be coupled to other system elements. The powered regulator gas control valve 27 is in fluid communication with regulator chamber 12 on one side (the outlet side) and pump 28 on the other side (the inlet side), typically by a tube 30 (e.g., a hose or flexible tubing).

The pump 28 provides breathing gases in response to a pump control signal 31 from another logic unit 24. Although depicted separately solely for ease of illustration in FIG. 1, it is to be understood that the functions of both logic units 24, 24*a* may be combined into a single logic unit residing in, e.g., a microprocessor or other processing element (e.g., a Field Programmable Gate Array or FPGA). In one embodiment, separate valve control logic units may be provided to control the operation of each powered regulator gas control valve 27, and one or more pump control logic units may be provided to control the operation of the pump. The pump control signal 31 may provide instructions for one or more of turning the pump on, turning the pump off, and instructing the pump to operate at a desired speed, or to increase or decrease the pumping speed. The pump 28 operates from a location remote from the diver, such as a floating pump assembly on the water surface, which may be self-righting and include, e.g., an inlet tube to prevent water from entering the pump inlet. Pump 28 delivers the breathing gases to the diver's mouthpiece/aperture 10 via tube 30, valve 27, and regulator chamber 12.

A differential pressure unit 43 provides a differential pressure signal 48 indicative of the pressure difference across the powered regulator gas control valve 27 to a logic unit 24. In one embodiment, the differential pressure sensor may comprise an upstream pressure sensor 45 coupled to the tube 30 (e.g., by a connector 46) on an upstream side of the powered regulator gas control valve 27 (i.e., between the pump and the valve 27 inlet), and a downstream pressure sensor 41 coupled to the tube 30 (e.g., by a connector 40) on a downstream side of the powered valve 27 (i.e., between the valve 27 outlet and the regulator chamber 12). Upstream and downstream pressure sensors 45, 41 provide upstream and downstream pressure signals 47*a* and 47*b*, respectively, to a processor or logic unit 46, which generates a differential pressure signal 48 indicative of the pressure difference across the powered regulator gas control valve 27. The upstream and downstream pressure sensors 45, 41 may comprise any of gauges, electronic pressure sensors, or other pressure sensing elements known in the art. Although FIG. 1 depicts the differential pressure unit 43 as comprising separate upstream and downstream pressure sensors 45, 41 and a processor or logic unit 46 to provide a differential pressure signal 48, other embodiments may use a single sensor to directly determine a pressure difference from, e.g., pressure taps in the tube 30 upstream and downstream of the powered regulator gas control valve 27 (see, e.g., FIG. 2).

As noted, the regulator pressure signal 22 from regulator pressure sensor 20 may be used by logic unit 24*a* to determine a plurality of breathing states and conditions, including without limitation inhalation or inhaling, exhalation or exhaling, and cessation or suspension of breathing. Other conditions such as breathing rate, acceleration of breathing, etc., may also be determined from the regulator pressure signal 22.

In the state of breathing cessation, the articulating element 14 and detection element 18 are balanced between the chamber 12 pressure and the external environmental pressure at port 16. Logic unit 24*a* uses the regulator pressure signal 22 from regulator pressure sensor 20 to detect that the articulating element 14 and detection element 18 are unbiased by breathing, and to determine that the diver is not breathing and that the powered regulator gas control valve 27 need not be open to supply breathing gas to the diver. Accordingly, control signal 25 from the logic unit 24*a* may close the powered valve 27.

In the state of inhalation, the articulating element 14 and detection element 18 are biased toward the chamber 12 and move toward the regulator pressure sensor 20. Logic unit 24 detects (e.g., based on the direction and magnitude of the change in the regulator pressure signal 22) that the articulating element 14 and detection element 18 indicate that the diver is inhaling, and determines that the powered regulator gas control valve 27 should be open to supply breathing gas to the diver. Logic unit 24*a* sends a valve control signal 25 to open the powered regulator gas control valve 27.

In the state of exhalation, the articulating element 14 and detection element 18 are biased outward from the chamber 12 and logic unit 24*a* detects (e.g., from the direction and magnitude of the change in the regulator pressure signal 22) that the articulating element 14 and detection element 18 indicate that the diver is breathing/exhaling. The logic unit 24*a* determines that the user is exhaling, and that the powered regulator gas control valve 27 need not supply breathing gas and should be closed to prevent exhalation gases (containing high levels of CO2) from traveling back toward the pump 28 supplying breathable gas to the diver. Logic unit 24*a* sends a valve control signal 25 to close the powered regulator gas control valve 27. Exhaled gases and any excess fluid (e.g., water) in the system may be exhausted via breathing gas outlet 34 or any conventional manner of exhaust valve known in the art.

As an additional measure to prevent the flow of exhaust gases back through tube 30 toward pump 28, an optional one-way check valve 29 may be provided in tube 30 coupling the breathing gas supply to the breathing mouthpiece/aperture 10. In the embodiment of FIG. 1, the one-way check valve 29 is positioned between the powered regulator gas control valve 27 and the regulator assembly 42. In a preferred embodiment, the one-way check valve (if provided) is positioned as close as practicable to the breathing mouthpiece 10. In an alternative embodiment, the one-way check valve 29 is positioned between pump 28 and powered regulator gas control valve 27.

Logic unit 24 may use the differential pressure signal 48 to minimize pumping energy by, in one embodiment, turning the pump 28 off when the powered regulator gas control valve 27 is closed, and turning the pump on when the powered regulator gas control valve is open. Logic unit 24 may also regulate the speed of the pump to provide an appropriate volumetric flow rate of breathing gas, e.g., 2 liters per second or other value, based on the pressure differential across the powered regulator gas control valve 27.

In some embodiments, a single pump 28 may support multiple divers, each having a separate regulator assembly 42, a separate powered regulator gas control valve 27, and a separate differential pressure unit 43. Logic unit 24 may control the operation of the pump 28 by, in one embodiment, continuing to operate the pump using the pump control signal 31 so long as any of the multiple powered regulator gas control valves 27 are open (indicating that at least one diver requires air or is inhaling), and turning off the pump when all of the multiple powered regulator gas control valves 27 are closed (indicating that no diver requires air/is inhaling at that particular moment).

In one embodiment, logic unit 24 may use the pump control signal 31 to run the pump 28 as long as all of the one or more differential pressure signals 48 are below a first threshold pressure difference. The first threshold pressure difference may comprise a maximum overhead pressure for the pump. While a diver is inhaling, the powered regulator gas control valve 27 is open to allow air to flow to the diver, resulting in a low pressure difference across the valve (and a low pressure difference signal 48), meaning that the pump must run to provide air to the diver. Conversely, when the diver exhales and the powered regulator gas valve 27 closes, pressure in tube 30 will begin to rise upstream of the powered regulator gas control valve 27 (assuming only a single diver). When the pressure reaches a desired maximum overhead pressure (e.g., 5 psi or less), the logic unit 24 may turn the pump 28 off. It will be appreciated that, for multiple divers, pressure upstream of a closed powered valve 27 for one diver will not rise appreciably while the powered valves 27 for other divers are open (i.e., while an alternative breathable gas flow path is open). However, when all of the powered regulator gas control valves 27 are closed, pressure in the tube 30 upstream of the valves 27 will rise until the desired maximum overhead pressure is reached, at which point the logic unit 24 may turn off the pump 28. In alternative embodiments, the pump 28 may continue to operate but at a substantially reduced speed, e.g., less than half of the speed when one or more of the multiple powered regulator gas control valves 27 are open, with a pressure relief valve (not shown) set for the maximum pressure being used to prevent excessive pressure in the tube 30.

Although FIG. 1 illustrates an embodiment in which the breathing gas is supplied to the diver by an electrically driven pump 28, alternative embodiments in which a different energy source is used to operate a pump 28 or compressor, or employing an entirely different source of breathing gas for delivery to the diver, are within the scope of the present disclosure.

This invention describes systems and methods for ensuring a reliable flow of breathable gases to a submerged diver. Referring again to FIG. 1, this is achieved by regulating the pressure in tube 30 by using logic units 24*a*, 24 to open or close a powered regulator gas control valve 27 and to control the operation of pump 28. Control of the powered regulator gas control valve 27 is based on the regulator pressure signal 22 from the regulator pressure sensor 20, while control of the pump is based on the differential pressure signal 48 from the differential pressure assembly 43. It is to be appreciated that a person of ordinary skill in the art may cause all control actions of logic unit 24 to be provided as hardware, firmware, software, etc., and that the illustration of separate logic units 24, 24*a* for controlling powered regulator gas control valve 27 and pump 28 is illustrative only and non-limiting. Similarly, multiple power sources 26 may be used, and this and all illustrations are to be considered non-limiting.

In some embodiments, a separate local pressure sensor (not shown) may be used to determine the water pressure at the local depth of the diver, which indicates the pressure that the pump 28 must develop (and slightly exceed) in tube 30 for breathing gas to be delivered to the diver. However, in some embodiments, the downstream pressure sensor 41 may be located proximate to the regulator assembly 42, in which case the pressure sensed by the sensor 41 will always be sufficiently close to the actual water pressure (differing only by, e.g., the pressure changes associated with the diver's respiration), and may be used as an indication of local diving pressure. The pressure sensors of FIG. 1 (and other figures) may comprise any of a variety of pressure sensors, and may be an encapsulated electronic sensor, a mechanical pressure gauge, or mechanical sensor with one or more articulating elements.

Figure 2:
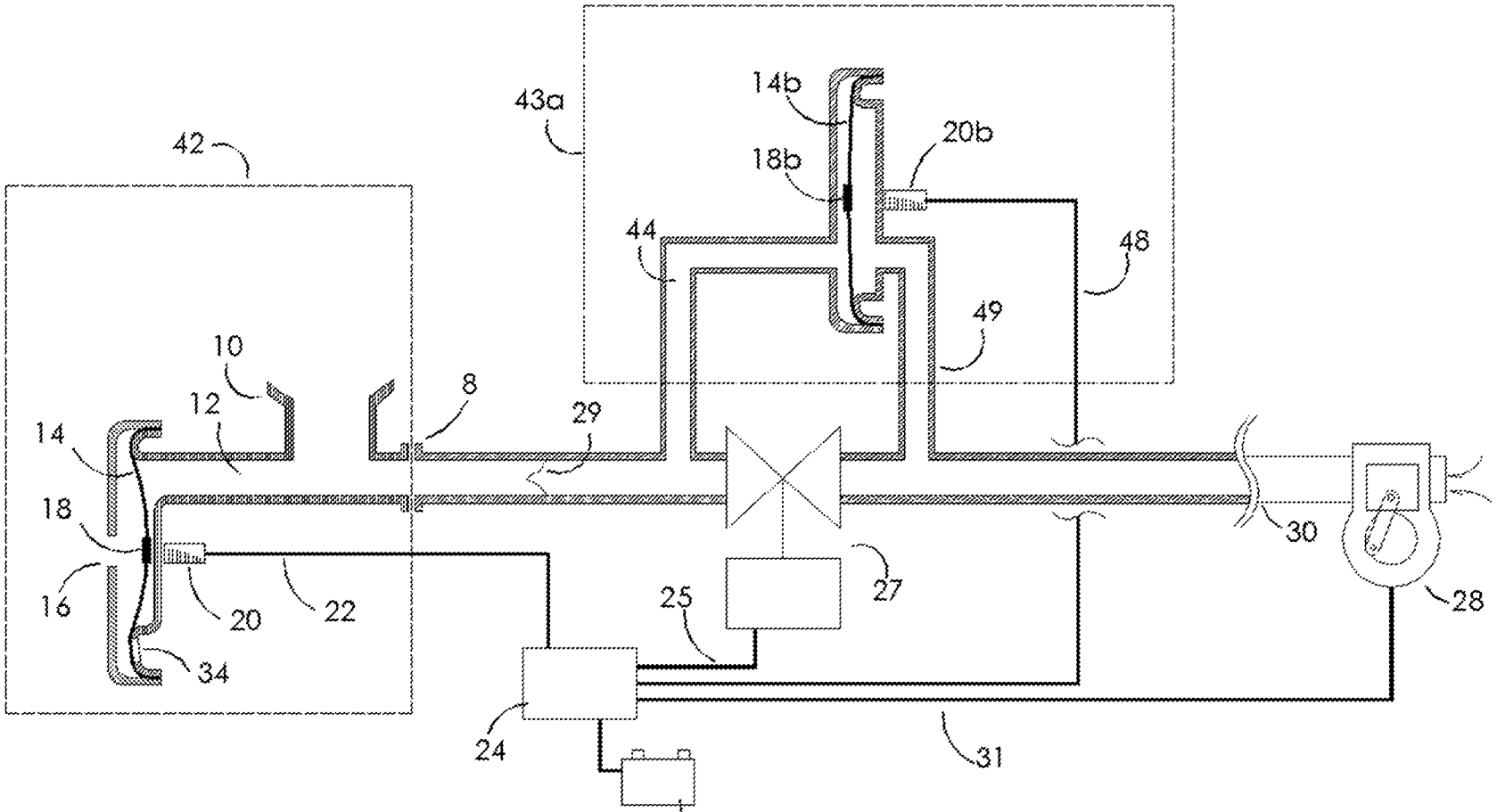
FIG. 2 is a functional system diagram of another embodiment of a diving system according to the present disclosure.

FIG. 2 illustrates another embodiment of an on demand system for providing breathable gases to a diver according to the present disclosure, in which an alternative differential pressure unit is provided. More specifically, a differential pressure unit 43*a* is provided that avoids the use of separate upstream and downstream pressure sensors such as sensors 45, 41 in FIG. 1 and instead uses mechanical elements with articulating elements similar to those used to detect breathing in FIG. 1, together with a differential pressure sensor 20*b* that directly provides a differential pressure signal 48 indicative of the pressure difference across the powered regulator gas control valve 27.

Referring again to FIG. 2, differential pressure unit 43*a* includes an articulating element 14*b* and a detection element 18*b* that are acted upon on one side (via conduit 44) by the gases in tube 30 downstream of powered regulator gas control valve 27, and simultaneously on the other side (via conduit 49) by the gases in tube 30 upstream (i.e., pump-side) of powered regulator gas control valve 27. Differential pressure sensor 20*b* provides a differential pressure signal 48 based on the proximity of detection element 18*b* to the sensor 20*b*. The differential pressure signal 48 is directly indicative of the pressure difference across the powered regulator gas control valve 27, and is used by logic unit 24 to generate and provide a pump control signal 31 to control the pump 28 operation (e.g., whether the pump is on or off, and its speed). It will be appreciated that in the embodiment of FIG. 2, a single logic unit 24 is used to provide both the valve control signal 25 to control the operation of the powered regulator gas control valve 27 (e.g., the position of the valve at any of a plurality of positions between fully closed and fully open) as well the pump control signal 31, but the illustration of division or consolidation of logic functions is nonlimiting.

In various embodiments, the differential pressure unit 43*a* and powered regulator gas control valve 27 may be located near the proximal (i.e., pump) end, the distal (i.e., regulator) end, or near the middle of tube 30. In some embodiments, the differential pressure unit may be proximal (including without limitation as part of) the inlet 8 to the regulator assembly 42. In some embodiments, one or both of differential pressure unit 43*a* and powered regulator gas control valve 27 are located at the surface among other system elements for packaging convenience, cost reduction, accessibility, reduced complexity of components at the diver's depth, or other advantages apparent to persons of ordinary skill in the art with the benefit of this invention. However, if the differential pressure unit 43*a* is co-located at the diver's depth, then the conduit 44 in fluid communication with air chamber 12 may in one embodiment be eliminated in favor of providing a port open to the environment at the diver's local depth similar to port 16.

As noted in connection with FIG. 1, in some embodiments, the pump 28 may also be caused to run constantly but at a reduced speed during exhalation, for example by using a pressure relief valve (not shown) to vent gases when a threshold overhead pressure above the local pressure at the diver's depth is reached (e.g., 1, 2, 3, 4, or 5 psi above local diving pressure). In a still further embodiment, the pump 28 may simply be allowed to run continuously at the limit of its volumetric efficiency, with the powered regulator gas control valve(s) 27 and/or a pressure relief valve (not shown) being used to avoid overpressuring tube 30. This may be implemented as a safety measure if, for example, a key component or system fails.

As some described embodiments allow for the pump 28 to stop (e.g., due to exhalation or closure of the powered regulator gas control valve(s) 27) in a situation with a local diving pressure of, e.g., 5-25 psi, and then resume pump operation at this relatively high pressure compared to the prior art '109 application, a preferred embodiment incorporates design features to allow the pump to resume operation despite a relatively high existing load (i.e., pressures) between the pump inlet and pump outlet.

In such an instance, it may be necessary for the logic unit to implement one or more strategies to start a pump in the presence of an existing back pressure load. One strategy is to cause the piston actuator to retreat to an unloaded position, then move in the normal pumping direction—building sufficient momentum to overcome the first compression stroke before the compression portion of the cycle. A second strategy involves causing an electrical energy build-up in the form of stored energy that can be abruptly dispatched into the pump motor. In the case of a 12V electrical pump as a non-limiting example, a capacitor of sufficient energy storage capacity (e.g. 1000 micro-Farads or more) to effect at least one pump stroke to begin the pumping momentum can be charged to 40V in preparation for a discharge cycle into the starting motor (example values are non-limiting) wherein after starting, normal 12V operation resumes. A third strategy involves causing a momentary relief of back pressure acting against the piston, and a fourth strategy involves causing a momentary balance of pressure acting on the piston by flooding both sides of the piston with the prevailing pressure. Combinations of any of the foregoing strategies may also be used, in addition to other means which may be established in the art, all being considered as non-limiting. In a preferred embodiment, a build-up of stored electrical energy is provided and abruptly discharged contemporary with high-load conditions.

Figure 4:
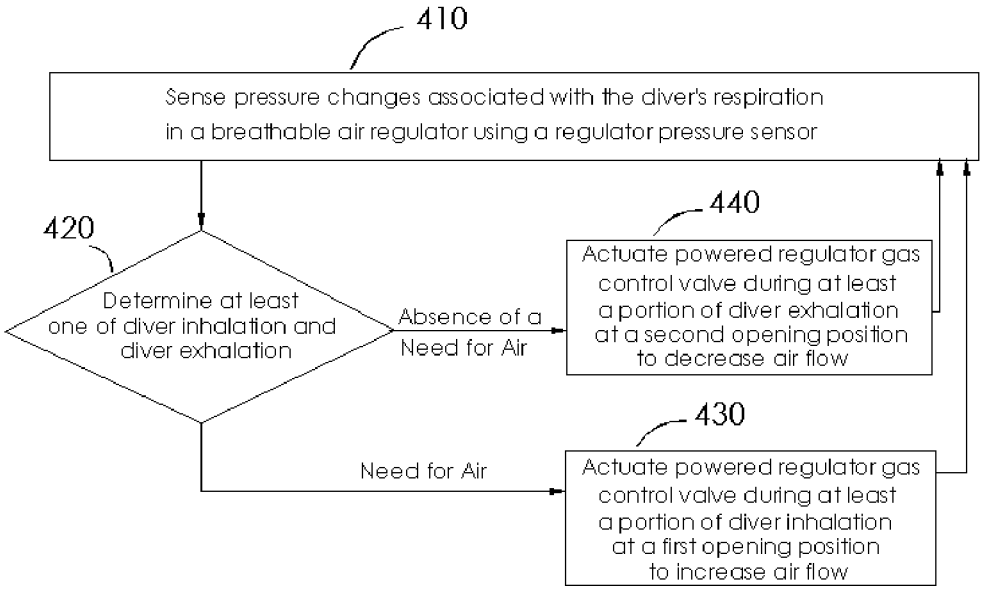
FIG. 4 is a flow chart of one embodiment of a method of operating a powered regulator gas control valve according to the present disclosure.

FIG. 4 is a flow diagram illustrating one embodiment of a method of controlling the operation of the powered regulator gas control valve 27 of FIGS. 1 and 2. The flow diagram may be implemented by, e.g., logic unit 24*a* (FIG. 1) or 24 (FIG. 2). The method includes sensing pressure changes associated with diver respiration in a breathable air regulator using a regulator pressure sensor (410). As noted in the discussion of FIGS. 1 and 2, the regulator assembly 42 includes a pressure sensor 20 coupled to the regulator assembly for sensing pressure changes during diver inhalation and diver exhalation. As the diver inhales, air withdrawn from the regulator chamber causes the pressure in regulator chamber 12 to drop slightly (e.g., by 1-2 inches of water), while breathing gases exhaled into the regulator causes the pressure in the regulator to rise by a similar magnitude.

The method further comprises determining at least one of diver inhalation and diver exhalation (420). A determination of at least one of inhalation and exhalation may be determined, e.g., by a logic unit 24, 24*a* (FIGS. 1, 2), based on the regulator pressure changes sensed by the pressure sensor 20. In one embodiment, the step of determining at least one of inhalation and exhalation (420) may occur repeatedly at a high speed (e.g., multiple times per second such as 2, 5, 10, 20, 50, 100 or even more times per second).

The method also includes actions taken in response to the determination of at least one of inhalation and exhalation, respectively. In this regard, the method includes opening or actuating (430) the powered regulator gas control valve 27 during at least a portion of diver inhalation (or a determination of a need for air) to a first valve position to deliver breathable air to the submerged diver. In one embodiment, the breathable air is delivered to the diver at a pressure that is less than a threshold overhead pressure, which in various embodiments may be no more than 20 psi, no more than 10 psi, no more than 5 psi, or no more than 3 psi above the diver's local environmental (e.g., water) pressure. In one embodiment, step 430 may include operating the valve at the first valve position during the entirety of diver inhalation to deliver breathable air at no more than the threshold overhead pressure. In some embodiments, step 430 may include causing the powered regulator gas control valve 27 to begin opening toward the first valve position slightly before or after the start of diver inhalation or determining the need for air. This may include, in one embodiment, causing the valve to begin moving toward the first opening position at a time point within a range of 0.5 seconds before to 0.5 seconds after a start of diver inhalation.

The method also includes the step of actuating (e.g., moving) the powered regulator gas control valve 27 during at least a portion of diver exhalation (or a determination of the absence of a need for air) to a second valve opening position to decrease air flow (440). In one embodiment, the second valve opening position is no greater than half the first valve opening position, including without limitation, zero (i.e., fully closed). In one embodiment, step 440 may include causing the powered regulator gas control valve 27 to begin actuation toward the second valve position slightly before or after a determination of diver exhalation or absence of a need for air is made. This may include, in one embodiment, causing the valve to begin moving toward the second valve opening position at a time point within a range of 0.5 seconds before to 0.5 seconds after a start of diver exhalation. In a particular embodiment, this may include positioning the powered regulator gas control valve 27 at a valve opening position of zero from the start of exhalation to the end of exhalation.

As noted, the step 420 of determining at least one of inhalation and exhalation may occur repeatedly at a high speed. When this is done repeatedly during diver exhalation, the step 440 of actuating the powered regulator gas control valve 27 during at least a portion of diver exhalation may comprise continuing to actuate valve 27 at the second valve position until a time point within a range of 0.5 seconds before to 0.5 seconds after a start of diver inhalation.

In one embodiment, when a determination (420) of exhalation is made immediately after diver exhalation begins, the powered valve 27 may still be positioned at the first valve position, and the step (440) of operating the pump during at least a portion of exhalation may comprise moving (e.g., closing) the valve 27 from the first valve position to the second valve position beginning at a time point within a range of 0.5 seconds before to 0.5 seconds after the start of diver exhalation. In another embodiment, moving the powered valve 27 to the second valve position may begin at a time point within a range of 0.25 seconds before to 0.25 seconds after a determination of diver exhalation is made in step 420.

In some embodiments, the method may also include a step (not shown) of causing the powered regulator gas control valve 27 to move to a first position to allow breathable air to flow to the diver in response to a manual input from the diver. This manual option provides an increased level of safety and reassurance to the diver, who may manually initiate opening of the powered valve 27, e.g., by pressing a button to cause air flow to clear the regulator of water.

Figure 5A:
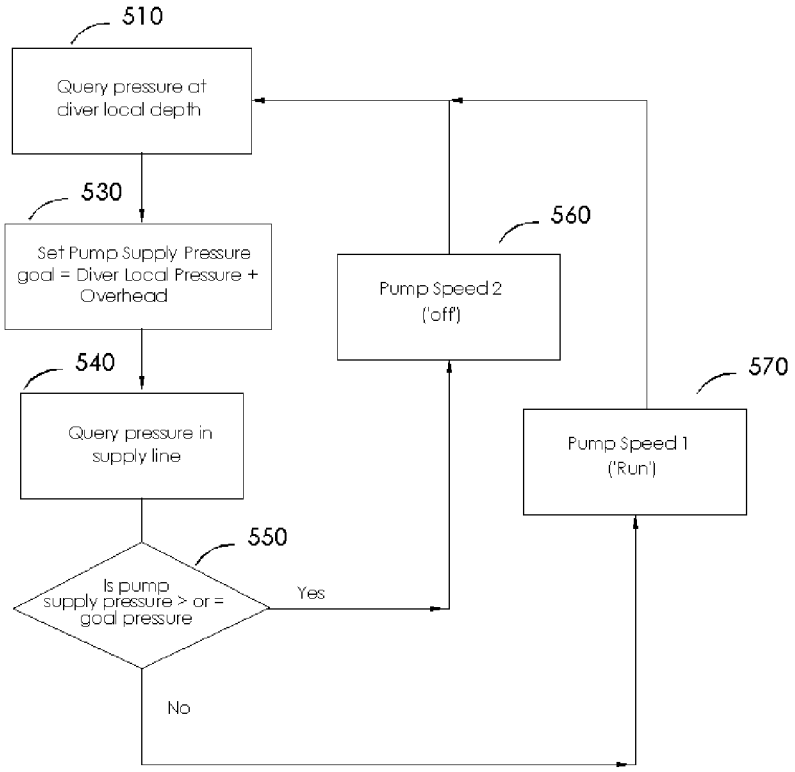
FIG. 5 is a flow chart illustrating one embodiment of a method of controlling a pump.

FIG. 5*a* is a flow diagram illustrating one embodiment of a method of controlling a pump, such as pump 28 of FIGS. 1 and 2, to deliver breathable gases to one or more submerged divers. The method may be implemented by, without limitation, logic unit 24 of FIG. 1. The method includes determining the pressure of the diver's location (510). In the embodiment of FIG. 1, the downstream pressure signal 47*b* of the downstream pressure sensor 41 may be taken as equivalent to the local diver pressure, particularly in embodiments where the differential pressure unit 43 is located near the regulator assembly 42. Although the downstream pressure sensor 41 actually measures the pressure in the regulator chamber 12, for purposes of operating the pump 28 this pressure may be accepted as the local diver pressure because the pressure changes associated with the diver respiration typically cause pressure fluctuations from local pressure in very small increments, on the order of ~1-2 inches of water.

Referring again to FIG. 5, the method further comprises setting a pump supply (i.e., outlet) pressure goal (530). In one embodiment, the outlet pressure goal may be set as the local diver pressure plus a desired overhead pressure upper limit threshold. The overhead pressure, as previously noted, is the difference between the pump 28 outlet pressure and the pressure required to deliver gas to the diver at the local pressure. In various embodiments of the present invention, the overhead pressure upper limit threshold may be a value that is no more than 20 psi, no more than 10 psi, no more than 5 psi, or no more than 3 psi, with preferred embodiments providing breathing gas at 1 psi or less overhead pressure.

Once a goal outlet pressure for pump 28 is established, the method comprises determining (540) the pressure in the supply line (i.e., the pressure in tube 30 upstream of the powered regulator gas control valve 27). In the embodiment of FIG. 1, this may be directly taken as the upstream pressure signal 47*a* of the upstream pressure sensor 45.

The method further comprises comparing the pump 28 outlet/supply line pressure to the pump outlet goal pressure (550) to determine if the supply line pressure is greater than the goal pump 28 outlet pressure. In one embodiment, the method comprises operating the pump at a first speed (570) as long as the pump outlet (i.e., supply line) pressure is not greater than the goal pressure, and operating the pump at a second speed (560) when the supply line is equal to or greater than the goal pressure. The second speed may be zero (or off) in some embodiments.

As noted, the method may be implemented by logic unit 24 using one or more pressure signals 47*b*, 47*a*, 48 to set a pump outlet/supply pressure goal and to generate and provide a pump control signal 31 to operate the pump 28 based on a sensed present or instantaneous condition or state vs. a goal condition or state. In a preferred embodiment, pumping speed is variable and increases as the pressures are farther from the pump outlet goal pressure, and decreases as the pressures approach the outlet goal pressure. In yet another embodiment, the pump is commanded to continue running—even at a slow speed—despite meeting the outlet pressure goal as a means to maintain motor momentum and reduce start-stop wear and tear on the components. The method may be implemented as a continuous loop by continuing to query local pressure (510) at a subsequent timepoint and repeating the foregoing steps.

Figure 5B:
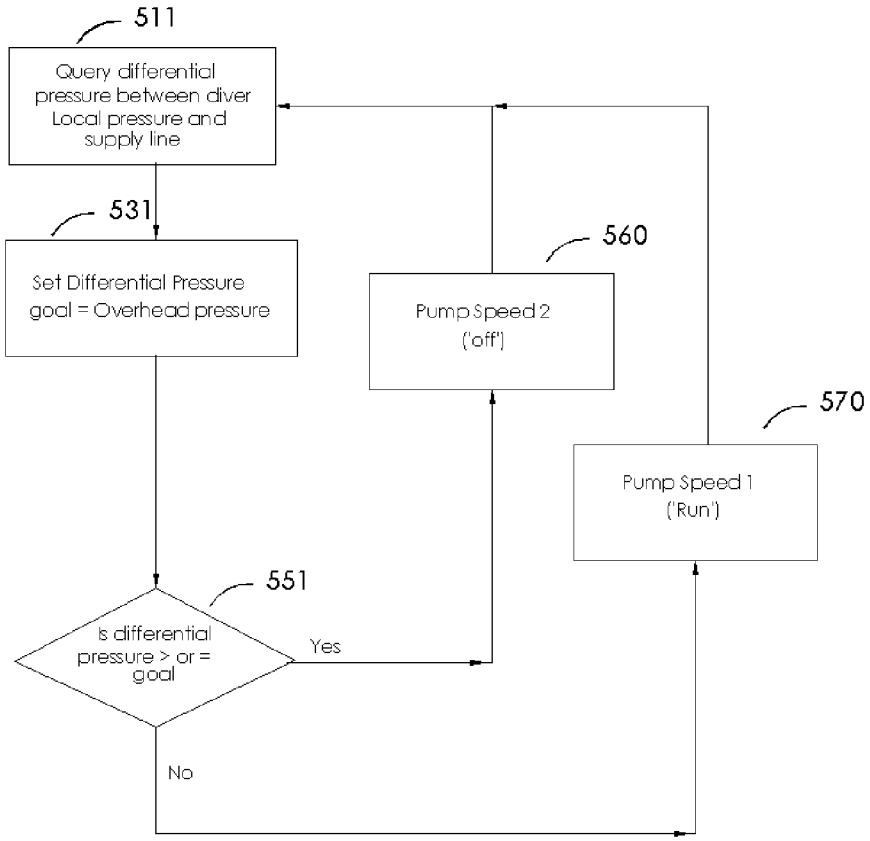

FIG. 5*b* is a flow diagram illustrating another embodiment of a method of controlling a pump to deliver breathable gases to one or more submerged divers. In one embodiment, the pump may comprise pump 28 of FIGS. 1 and 2, and the method may be implemented by, without limitation, logic unit 24 of FIG. 2. In the embodiment of FIG. 5*b*, the method comprises determining a differential pressure indicative of the difference between the supply line and local diver pressure (511). This may be obtained, in the system of FIG. 2, directly from the differential pressure signal 48 of differential pressure unit 43*a*.

The method further comprises setting a differential pressure goal (531), which may be set equal to a desired overhead pressure upper limit threshold. In various embodiments, the overhead pressure upper limit threshold may be a value that is no more than 20 psi, no more than 10 psi, no more than 5 psi, or no more than 3 psi, with preferred embodiments having an overhead pressure upper limit threshold of 1 psi or less.

The method also comprises comparing the differential pressure for an actual timepoint to the differential pressure goal (551), and operating the pump 28 at the first speed (570) as long as the differential pressure is less than the overhead pressure upper limit threshold, and is operated at the second speed (560) when the differential pressure equals or exceeds the overhead pressure upper limit threshold. As noted for FIG. 5*a*, the second speed may be zero in some embodiments.

In a preferred embodiment, pumping speed is variable and increases as the pressures are farther from the outlet goal pressure, and decreases as the actual (sensed) pump outlet pressures approach the outlet goal pressure. In another embodiment, the pump is commanded to continue running at a reduced speed despite meeting the outlet pressure goal as a means to maintain motor momentum and reduce start-stop wear and tear on the components. The method may be implemented as a continuous loop by continuing to query local pressure (511) at a subsequent timepoint and repeating the foregoing steps.

Figure 6:
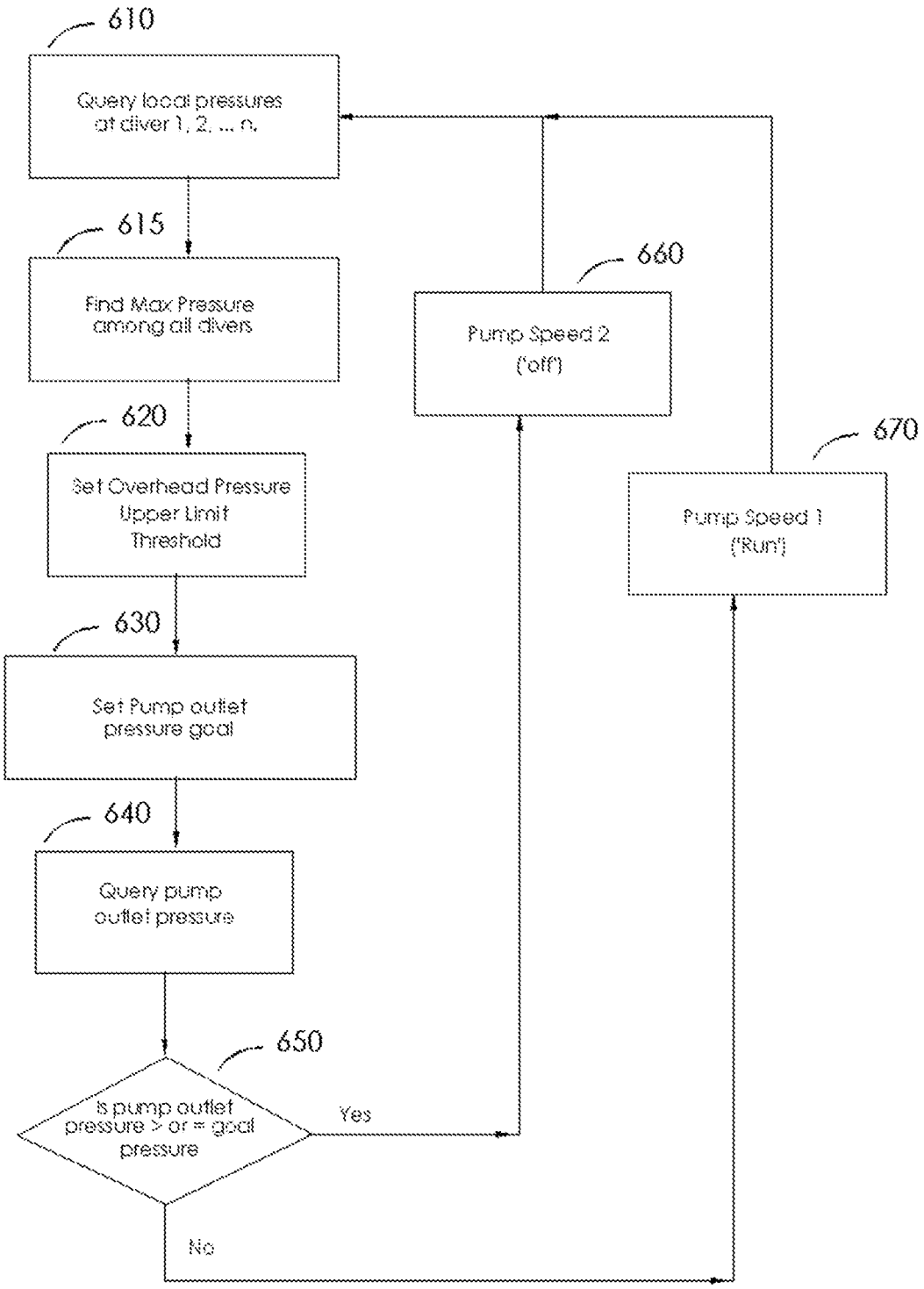
FIG. 6 is a flow chart illustrating one embodiment of a method of controlling a pump for suppling breathing air to multiple divers.

FIG. 6 is a flow diagram of an embodiment of a method of controlling a pump to deliver breathable gases to a plurality n of submerged divers. The method may be implemented in one embodiment using pump 28 and logic unit 24 of FIGS. 1 and 2. The method comprises determining (610) the local pressure of each of the n submerged divers. This determines the water pressure which must be overcome at the divers' local depths to allow for inspiration. In one embodiment (FIG. 1), the local pressure may be taken as the downstream pressure signal 47*b* of the downstream pressure sensor 41 of differential pressure unit 43.

Because multiple divers may exist at different depths, yet they share the pressure output of a single pump 28 in this configuration, the pump 28 outlet (supply line) pressure will be dictated by the diver at the greatest depth. Accordingly, the method comprises determining the maximum pressure among all divers (615).

The method further comprises setting an overhead pressure upper limit threshold (620). As noted, overhead pressure is the difference between the pump outlet pressure and the pressure required to deliver gas to the diver at the local pressure. For flow to the diver to occur at all, the pump outlet pressure must exceed the diver's local pressure, and the magnitude by which the pump outlet pressure exceeds the required pressure is the overhead. Overhead pressure represents wasted energy and should desirably be minimized, but it also represents additional volume of breathing gas stored in the system as the pressure increases the density of the stored breathing gas. In the event of an unexpected compressor stoppage, this "additional" breathing gas can supply additional breaths of air to the submerged diver(s), which becomes increasingly helpful to conduct a safe ascent as diver depth increases. Since risk increases with increasing diver depth, in one embodiment the overhead pressure goal may be varied (e.g., by logic unit 24) as a function of the maximum diver depth. For example, if the maximum diver depth is 10 feet, the overhead pressure may be set at zero since all divers can reach the surface on one or even no additional breaths. However, if the maximum diver depth is 30 feed, the method may comprise setting the overhead pressure at 15 psi. In one embodiment, the logic unit 24 may use a lookup table or mathematical function to determine an increasing overhead pressure goal (620) for pump 28 based on the maximum local diver pressure determined in step 615.

With the benefit of this disclosure and the rapid and wide-opening properties of the powered regulator gas control valve, the amount of overhead pressure may be minimized to, e.g., 20 psi, 9 psi, 5 psi, 4 psi, 3 psi, 2 psi, or in preferred embodiments, 1 psi or less overhead pressure, while allowing the overhead pressure to increase with increasing diver depth where greater air volume stored in tube 30 is increasingly beneficial to serve as emergency ascent air supplies. Existing commercial systems using a constant, invariable (and relatively high) overhead pressure. However, this fixed overhead pressure also has the undesirable effect of providing a decreasing effective reserve as maximum diver depth increases, just as the diver's depth-related risk exposure increases.

Once the overhead pressure goal is established, the method further comprises setting a pump 28 outlet (supply line) pressure goal (630). In one embodiment this comprises the maximum diver pressure from step 615 plus the overhead pressure goal of step 620.

The method further comprises determining the pump outlet (supply line) pressure (640). The outlet pressure is then compared (650) to the pump goal pressure from step 630 to determine if the pump outlet pressure exceeds the goal pressure. In one embodiment (FIG. 1) the outlet pressure may be obtained as the upstream pressure signal 47*a* of upstream pressure sensor 45.

If the pump 28 outlet (supply line) pressure is less than the goal pressure, the method comprises running the pump (670) at a first speed as long as the pump outlet/supply pressure continues to be less than the goal pressure. Conversely, if the pump 28 outlet/supply line pressure equals or exceeds the goal pressure, the method comprises running the pump at a second speed if the pump outlet pressure equals or exceeds the goal pressure. In one embodiment the second speed may be zero. In a preferred embodiment, pumping speed is variable and increases as the pump outlet pressure falls farther below the pump outlet pressure goal set in step 630. In another embodiment, the pump is commanded to continue running at a reduced second speed despite meeting the outlet pressure goal as a means to maintain motor momentum and reduce start-stop wear and tear on the components.

In an alternative embodiment, the step of setting a specific pump outlet goal (630) is omitted, and the differential pressure signal 48 from the diver having the maximum local pressure is compared (640) to the overhead pressure upper limit threshold set in step 620. The pump is operated at a first speed as long as the differential pressure for the diver having the maximum local pressure is below the overhead pressure upper limit threshold, and is operated at a second speed (which may be zero or a greatly reduced speed) if the differential pressure for the diver with the maximum local pressure is greater than or equal to the overhead pressure upper limit threshold.

The method may be implemented as a continuous loop by continuing to query local diver pressures (610).

Figure 3:
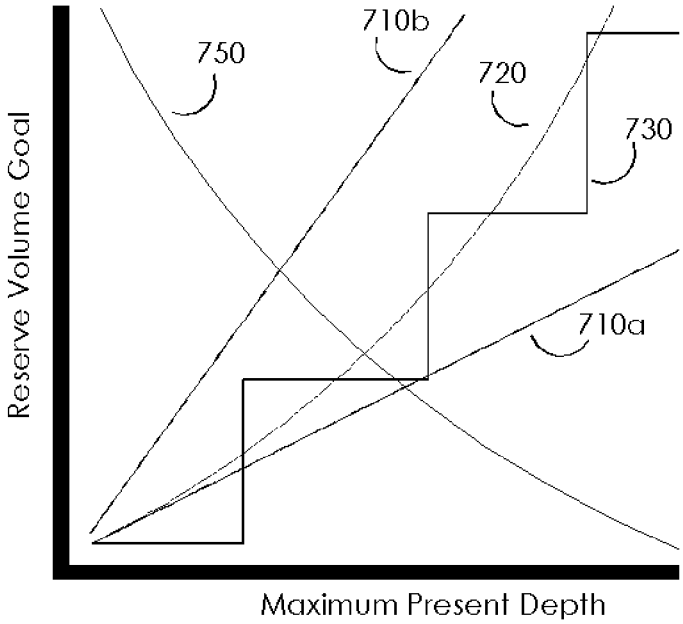
FIG. 3 is an illustration of an embodiment of providing a variable overpressure according to the present invention.

FIG. 3 is an illustration of an embodiment of providing a variable overhead pressure in operating a pump to provide breathing air to one or more submerged divers. Existing commercial hookah systems use a fixed (and relatively high) pump outlet pressure goal that ignores diver depth, with the result that the diver safety margin decreases as the depth (and risk) increases. In particular, as the diver descends deeper, the air pressure required for respiration increases. But because the pump outlet pressure goal is fixed, the overhead pressure (i.e., the difference between the pressure required to pump air to the diver at the local pressure and the pump outlet pressure goal) decreases as the diver descends. Thus, the effective "reserve volume" of air represented by overpressure, decreases with depth, as illustrated by line 750.

By combining knowledge of diver depth with precise control over pumping pressure overheads, the present invention allows for increasing the safety extra air supply with depth. In one embodiment, the increasing reserve volume could be provided in the form of a linearly increasing reserve volume with deeper depth, as shown by line 710*a*. In another embodiment, (710*b*) the reserve pressure is accumulated more rapidly in presence of multiple divers to provide for more total breathing air reserve to serve more total divers. It will be appreciated that such a strategy of increasing reserves in accord with more users can be applied to other of the relationships in FIG. 3; not illustrated here for the sake of simplicity.

In another embodiment, the reserve pressure is increased with depth in a non-linear relationship (720) to provide for a consistent reserve volume-at-local-pressure in accord with the volumetric dilation which occurs with depth in accord with Boyle's Law. In another embodiment (730), reserves are held constant with increasing depth until such time as a quantum measure of an additional extra breath is called-for in consideration of the number of breaths in reserve necessary for a safe ascent.

Advantages of the present invention include, without limitation, benefits which can arise from achieving underwater breathing using less energy than the prior art. These include but are not limited to lower component cost, lower weight, and longer usable duration for any given energy source. Present systems on the market are so large that airline transport is unwieldy (for example, two automobile batteries are used, and the flotation bladder is the size of an automobile tire) and the swimming-force required to drag them while moving in the water is substantial. Embodiments of the present invention can be accomplished in the size and weight smaller than airline carry-on luggage, yet still deliver over an hour of breathable air delivery from an on-board energy source (e.g., a battery). One means by which the invention herein achieves lower energy use is by utilizing significantly lower pressures than scuba and hookah systems. Lower system pressures facilitate improved safety, less heat buildup at the compressor, less component wear, and less starting load. In one prior implementation, the same low system pressures are used, at the cost of free-flowing the pumped air past the diver's mouth (ref: U.S. Pat. No. 7,159,528 B1). This has at least two disadvantages in that the pump runs and consumes energy constantly, and that a constant, distracting stream of exhaust bubbles flows past the diver creating noise, pressure waves, and visual disturbances which are doubled during exhalation.

In a broad embodiment, the present invention provides an apparatus to sense a diver's respiratory inhalation actions and deliver only that amount of gas volume and pressure required at the diver's location by means of controlling the actions of a valve more or less instantaneously with inhalation demand (e.g. less than 0.5 seconds with preferred embodiments less than 0.1 seconds), and providing compressed breathing gas at the lowest pressures necessitated by the diver's instantaneous present depth. In one embodiment, the present disclosure provides such an apparatus with an overhead pressure of 5 psi or less, such as 4 psi, 3 psi, 2 psi or even 1 psi above the diver's local pressure at a given instant.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention.

All of the methods and apparatus disclosed and claimed herein may be made and executed without undue experimentation in light of the present disclosure. While the method and apparatus of this invention have been described in terms of particular embodiments, it will be apparent to those of skill in the art that variations may be applied to the apparatus described herein without departing from the concept, spirit and scope of the invention. It should be especially apparent that the principles of the invention may be applied with other modes of sensing including optical, capacitive, resistive, sonic, and the like, and that the users of remotely supplied breathing gases may be other than those performing underwater diving.

In various embodiments, the present invention relates to the subject matter of the following numbered paragraphs:

51. A system to provide breathable gases to a submerged diver, comprising:

a pump having a pump inlet fluidly coupled to a source of breathable gases at a first pressure and a pump outlet providing pressurized breathable gases to a submerged diver at a second pressure greater than the first pressure;

a breathable gas regulator assembly including a regulator chamber having a regulator inlet, a regulator outlet, a mouthpiece fluidly coupled to the regulator chamber and having a breathing aperture, an articulating element, and a regulator pressure sensor to provide a regulator pressure signal indicative of whether breathable gases are needed by the diver based on movement of the articulating element;

a tube coupling the pump outlet to the regulator inlet;

a powered regulator gas control valve located between the pump outlet and the regulator chamber;

a differential pressure sensor assembly to sense a pressure difference across the powered regulator gas control valve and to provide a differential pressure signal indicative of the pressure difference across the powered regulator gas control valve; and at least one logic unit to control the operation of the pump based on the differential pressure signal and the operation of the powered regulator gas control valve based on the regulator pressure signal.

52. The system of claim 51, wherein the logic unit processes the differential pressure signal to produce a pump control signal to control the operation of the pump.

53. The system of claim 51, wherein the logic unit processes the regulator pressure signal to produce a valve control signal to control the operation of the powered regulator gas control valve.

54. The system of claim 51, wherein the pump provides pressurized breathable gases to a submerged diver at a second pressure that is not substantially greater than the pressure necessary to supply the needed gas volume at the local water pressure of the diver.

55. The system of claim 51, wherein the pump provides pressurized breathable gases to a submerged diver at a pump outlet pressure of no more than 20 psi above the local pressure of the diver.

56. The system of claim 51, wherein the pump provides pressurized breathable gases to a submerged diver at a pump outlet pressure of no more than 15 psi above the local pressure of the diver.

57. The system of claim 51, wherein the pump provides pressurized breathable gases to a submerged diver at a pump outlet pressure of no more than 10 psi above the local pressure of the diver.

58. The system of claim 51 further comprising a buoyant element, wherein said pump is coupled to said buoyant element.

59. The system of claim 51, wherein the regulator pressure signal is indicative of at least one of inhalation and exhalation by the diver.

60. The system of claim 59, wherein the regulator pressure sensor is an electronic sensor, and wherein the logic unit determines at least one of diver inhalation and diver exhalation based on the regulator pressure signal, and provides a valve control signal to actuate the powered regulator gas control valve to an open position during at least a portion of diver inhalation, and to a closed position during at least a portion of diver exhalation.

61. The system of claim 59, wherein the logic unit determines a pressure difference across the powered regulator gas control valve, and provides a pump control signal to run the pump at a first speed when the pressure difference across the powered regulator gas control valve is less than a first threshold pressure difference, and at a second speed when the pressure difference across the powered regulator gas control valve is greater than or equal to the first threshold pressure difference.

62. The system of claim 61, wherein the system comprises at least two breathable gas regulator assemblies, at least two tubes wherein each tube fluidly couples an inlet of one regulator assembly to the pump outlet, at least two powered regulator gas control valves, and at least two differential pressure sensor assemblies.

62. The system of claim 51, wherein said system comprises a single pump and a single tube, and provides breathing gas to a single diver.

63. The system of claim 51, wherein the logic unit provides a valve control signal to actuate the powered gas regulator control valve to one of a plurality of open positions, each open position allowing breathable gas from the pump to flow through the valve at a different flow rate.

101. A system to provide breathable air to a submerged diver, including:

a floating pump assembly comprising:

a buoyant element, a pump coupled to said buoyant element, said pump having a pump inlet fluidly coupled to the atmosphere, and a pump outlet, said pump operating to provide pressurized breathable air at the pump outlet at a pressure greater than atmospheric pressure;

at least two breathable gas regulator assemblies, each assembly being usable by a single diver and including:

a regulator chamber having a regulator inlet and a regulator outlet, a mouthpiece fluidly coupled to the regulator chamber and having a breathing aperture, and a regulator pressure sensor to sense pressure changes within the regulator chamber associated with diver inhalation and exhalation and to provide a regulator pressure signal indicative of the pressure changes;

a powered regulator gas control valve located between the pump outlet and the regulator chamber; and a differential pressure sensor assembly to provide a differential pressure signal indicative of the pressure difference across the powered regulator gas control valve;

tubing coupling the pump outlet to each of the at least two breathable gas regulator assemblies; and at least one logic unit to control the operation of the pump in providing breathable air to the diver based on the pressure differential signals of the at least two breathable gas regulator assemblies, and to control the operation of each powered regulator gas control valve based on the associated regulator pressure signal.

102. The system of claim 101 wherein each of the at least two breathable air regulator assemblies further comprises an articulating element, wherein the articulating element moves in response to pressure changes associated with diver inhalation and exhalation, and wherein each regulator pressure sensor senses pressure changes within the regulator chamber based on movement of the articulating element.

103. The system of claim 101 wherein the at least one logic unit comprises:

at least valve control one logic unit to control the operation of the powered regulator gas control valve based on the regulator pressure signal; and at least one pump control logic unit to control the operation of the pump in providing breathable air to the diver based on the pressure differential signals of the at least two breathable gas regulator assemblies.

104. The system of claim 101 wherein the at least one logic unit processes the differential pressure signal for each of the at least two breathable gas regulator assemblies to produce a pump control signal for each respective breathable gas regulator assembly.

105. The system of claim 101 wherein the at least one logic unit processes the regulator pressure signal for each of the at least two breathable gas regulator assemblies to produce a valve control signal to control the operation of the powered regulator gas control valve for each respective breathable gas regulator assembly.

106. The system of claim 101, wherein the pump provides pressurized breathable gases to a submerged diver at a pressure that is not substantially greater than the pressure necessary to supply the needed gas volume at the local pressure of the diver.

107. The system of claim 101 wherein the pump provides pressurized breathable gases to a submerged diver at a pump outlet pressure of no more than 20 psi above the local pressure of the diver.

108. The system of claim 101, wherein the pump provides pressurized breathable gases to a submerged diver at a pump outlet pressure of no more than 15 psi above the local pressure of the diver.

109. The system of claim 101, wherein the pump provides pressurized breathable gases to a submerged diver at a pump outlet pressure of no more than 10 psi above the local pressure of the diver.

110. The system of claim 101, wherein the regulator pressure signal is indicative of at least one of inhalation and exhalation by the diver.

111. The system of claim 110, wherein for each of the at least two breathable gas assemblies, the logic unit:

determines at least one of diver inhalation and diver exhalation based on the regulator pressure signal, and provides a valve control signal to actuate the powered regulator gas control valve to an open position during at least a portion of diver inhalation, and to a closed position during at least a portion of diver exhalation.

112. The system of claim 110, wherein for each of the at least two breathable gas assemblies, the logic unit determines a pressure difference across the powered regulator gas control valve, and provides a pump control signal to run the pump at a first speed when the pressure difference across the powered regulator gas control valve is less than a first threshold pressure difference, and at a second speed when the pressure difference across the powered regulator gas control valve is greater than or equal to the first threshold pressure difference.

113. The system of claim 112, wherein the first threshold pressure difference is a value of 2.0 psi or less.

114. The system of claim 112, wherein the second speed is zero.

114. The system of claim 101, wherein for each of the at least two breathable gas assemblies, the logic unit provides a valve control signal based on the regulator pressure signal to actuate the powered gas regulator control valve to one of a plurality of open positions, each open position allowing breathable gas from the pump to flow through the valve at a different flow rate.

201. A regulator assembly for a submerged diver, comprising:

a regulator body comprising:

a regulator chamber having a regulator inlet and a regulator outlet;

a mouthpiece fluidly coupled to the regulator chamber and having a breathing aperture through which the diver inhales and exhales;

a regulator pressure sensor to sense pressure changes within the regulator chamber associated with diver inhalation and exhalation and to provide a regulator pressure signal indicative of the pressure changes; and a powered regulator gas control valve coupled to the regulator inlet.

202. The regulator assembly of claim 201, further comprising an articulating element capable of moving in response to inhalation and exhalation of a diver, wherein said pressure sensor provides said regulator pressure signal based on movement of the articulating element.

203. The regulator assembly of claim 201, wherein said pressure sensor provides a regulator pressure signal having a value in proportion to the magnitude of the pressure in the regulator body.

204. The regulator assembly of claim 202, wherein the pressure sensor provides a regulator pressure signal having a value in proportion to the magnitude of the movement of the articulating element.

205. The regulator assembly of claim 201, further comprising a differential pressure sensor assembly to provide a differential pressure signal indicative of the pressure difference across the powered regulator gas control valve.

206. The regulator assembly of claim 201, further comprising tubing having a first end coupled to the breathing gas inlet and a second end adapted to be coupled to a breathing gas source.

207. The regulator assembly of claim 201, further comprising a logic unit to control the operation of the powered regulator gas control valve based on the regulator pressure signal.

208. The regulator assembly of claim 207, wherein the logic unit processes the regulator pressure signal to provide a valve control signal to control the operation of the powered regulator gas control valve.

209. The regulator assembly of claim 207, wherein the logic unit determines at least one of diver inhalation and diver exhalation based on the regulator pressure signal, and provides a valve control signal to actuate the powered regulator gas control valve to an open position during at least a portion of diver inhalation, and to a closed position during at least a portion of diver exhalation.

401. A system to provide breathable gases to at least one submerged diver, comprising:

a pump having a pump inlet fluidly coupled to a source of breathable gases at a first pressure and a pump outlet providing pressurized breathable gases to a submerged diver at a second pressure greater than the first pressure;

at least one breathable gas regulator assembly including a regulator chamber having a regulator inlet, a regulator outlet, a mouthpiece fluidly coupled to the regulator chamber and having a breathing aperture;

a pressure sensor for sensing a local water pressure of the diver and providing a pressure signal indicative of the local water pressure;

a breathable gases reservoir coupled to the pump outlet and the at least one breathable gas regulator assembly, from which the at least one submerged diver breathes breathable gases;

a tube coupling the pump outlet to the regulator inlet; and at least one logic unit to control the operation of the pump based on the pressure signal.

402. The system of claim 401, further comprising a pressurized breathable gas reservoir, wherein the at least one logic unit operates the pump to maintain the pressure above a first pressure threshold as the diver breathes air from the reservoir.

403. The system of claim 402, wherein the logic unit adjusts the first pressure threshold based on the pressure signal indicative of the local water pressure.

404. The system of claim 403, wherein the first pressure threshold is adjustable.

405. The system of claim 401, wherein the reservoir comprises at least one of a tank and high pressure tubing.

406. The system of claim 401, wherein the pressure sensor is proximate to the breathable gas regulator assembly.

501. A method to provide breathable gases to one or more submerged divers in a system comprising a pump for providing breathable gas to the one or more submerged divers, a pressurized reservoir for receiving compressed breathable gas from the pump, at least one breathable gas regulator coupled to the pressurized reservoir and having an inlet and an outlet coupled to a regulator chamber, and at least one pressure sensor for sensing a local water pressure of each of the one or more divers, the method comprising:

sensing a local water pressure of each of the one or more divers and providing a local water pressure signal for each of the one or more divers indicative of the local water pressure of the diver; and operating the pump to pump to maintain a pressure in the reservoir above a threshold pressure, wherein the threshold pressure value is based on the local water pressure signals.

502. The system of claim 501, further comprising:

adjusting the threshold pressure as the local water pressure signals change in response to changes in the depth of the at least one diver.

503. The system of claim 501, wherein adjusting the threshold pressure comprises increasing the threshold pressure based on an increase in a local water pressure signal from one of the at least one diver.

701. A method of providing breathable gas to one or more submerged divers in a system comprising a pump for providing breathable gas to the one or more submerged divers, and a diving subsystem for each of the one or more divers, the diving subsystem comprising a) a breathable gas regulator having an inlet, an outlet, a regulator chamber, and a regulator pressure sensor, b) a powered regulator gas control valve located between the pump and the regulator chamber, and c) a tube coupling the pump to the regulator, the method comprising:

for each of the diving subsystems:

sensing pressure changes in the regulator associated with diver respiration using the regulator pressure sensor;

determining, based on the sensing, one of a need for air by the diver and the absence of a need for air by the diver;

operating the powered regulator gas control valve by opening the valve to allow breathable gas to flow from the pump to the breathable gas regulator in response to a determination of a need for air by the diver, and by closing the valve to prevent the flow of breathable gas from the pump to the breathable gas regulator in response to a determination of the absence of a need for air by the diver;

determining a pressure difference across the powered regulator gas control valve; and providing a pump control signal based on the pressure difference across the powered regulator gas control valve; and operating the pump, based on the pump control signals for each of the one or more divers, to provide breathing gas at a pump outlet pressure of no more than 20 psi above the highest local pressure of the one or more divers.

702. The method of claim 701, wherein operating the pump based on the pump control signals comprises:

turning the pump on within 0.5 seconds after determining that the pressure difference across any one of the powered regulator gas control valves is less than a first threshold pressure difference; and turning the pump off within 0.5 seconds after determining that the pressure difference across all of the powered regulator gas control valves is greater than the first threshold pressure difference.

703. The method of claim 701, further comprising:

providing a floating pump assembly comprising a buoyant element to which said pump is coupled.

704. The method of claim 7011, wherein operating the pump comprises:

operating the pump to provide breathable gas to the one or more submerged divers at a pump outlet pressure of not more than 20 psi (103 kpa) above atmospheric pressure.

706. The method of claim 701, wherein operating the pump based on the pump control signals for each of the one or more divers comprises:

running the pump at a speed that is proportional to the number of powered regulator gas control valves that are in an open position.

707. The method of claim 701, wherein operating the pump based on the pump control signals comprises:

running the pump when the pressure difference across any one of the powered regulator gas control valves is less than a first threshold pressure difference; and not running the pump when the pressure difference across all of the powered regulator gas control valves is greater than the first threshold pressure difference.

708. The method of claim 701, wherein the first threshold pressure difference is a value of 2.0 psi or less.

What is claimed is:

1. A method of providing breathable gas to a plurality of submerged divers in a system comprising a pump for providing the breathable gas to the plurality of submerged divers, wherein each of the plurality of submerged divers is provided with a breathable gas regulator comprising an inlet and an outlet and having a regulator pressure sensor coupled thereto, a powered regulator gas control valve, and a tube coupling the breathable gas regulator to the pump, the method comprising:

for each one of said plurality of divers:

sensing pressure changes in the breathable gas regulator associated with diver respiration using the regulator pressure sensor;

determining at least one of diver inhalation and diver exhalation based on said sensing;

operating the powered regulator gas control valve to allow breathable gas to flow from the pump to the breathable gas regulator during at least a portion of diver inhalation, and to prevent the flow of breathable gas from the pump to the breathable gas regulator during at least a portion of diver exhalation;

determining a pressure difference across the powered regulator gas control valve; and providing a pump control signal based on the pressure difference across the powered regulator gas control valve; and operating the pump based on the pump control signals for each of said plurality of divers, to provide breathable gas at a pump outlet pressure of no more than 5 psi above the highest local pressure of the plurality of divers.

2. The method of claim 1, wherein operating the powered regulator gas control valve comprises:

actuating the valve to an open position during at least a portion of diver inhalation, and actuating the valve to a closed position during at least a portion of diver exhalation.

3. The method of claim 2, wherein operating the pump based on the pump control signals comprises:

running the pump at a speed that is proportional to the number of powered regulator gas control valves that are in an open position.

4. The method of claim 2, wherein actuating the valve to an open position comprises actuating the valve to one of a plurality of positions, each of said positions allowing breathable gas from the pump to flow through the valve at a different flow rate.

5. The method of claim 1, wherein operating the pump based on the pump control signals comprises:

running the pump at a first speed when the pressure difference across any one of the powered regulator gas control valves is less than a first threshold pressure difference; and running the pump at a second speed less than the first speed when the pressure difference across all of the powered regulator gas control valves is greater than the first threshold pressure difference.

6. The method of claim 5, wherein the second speed is zero.

7. The method of claim 5, wherein the first threshold pressure difference is a value of 2.0 psi or less.

8. The method of claim 5, wherein operating the pump based on the pump control signals comprises:

running the pump at a speed that is proportional to the difference between the pressure difference across at least one of the powered regulator gas control valves and the first threshold pressure difference.

9. The method of claim 1, wherein operating the powered regulator gas control valve comprises:

using a power source selected from an electrical power source, an optical power source, a pneumatic power source, and a magnetic power source to actuate the powered regulator gas control valve.

10. The method of claim 1, wherein each of the steps of:

sensing pressure changes in the regulator associated with diver respiration;

determining at least one of diver inhalation and diver exhalation; and determining a differential pressure across the powered regulator gas control value, is performed at a frequency of at least two times per second.

11. The method of claim 1, wherein each of the steps of:

sensing pressure changes in the regulator associated with diver respiration;

determining at least one of diver inhalation and diver exhalation;

operating the powered regulator gas control valve;

determining a differential pressure across the powered regulator gas control valve;

providing a pump control signal; and operating the pump based on the pump control signal, is performed at a frequency of at least two times per second.

12. The method of claim 1, further comprising:

causing the pump to pump breathable air to the diver in response to a manual input from the diver.

13. The method of claim 1, wherein:

the pump comprises a pump inlet coupled to the atmosphere and a pump outlet;

the tube comprises a proximal end coupled to the pump outlet and a distal end coupled to the breathable gas regulator;

the breathable gas regulator comprises a regulator inlet coupled to the distal end of the tube, a regulator chamber, a breathing aperture though which said submerged diver inhales and exhales, and a regulator outlet;

the powered regulator gas control valve is located between the pump outlet and the regulator inlet;

the regulator pressure sensor senses pressure changes in the regulator associated with diver respiration;

determining a pressure difference across the powered regulator gas control valve comprises using a differential pressure sensor for determining the pressure difference across the powered regulator gas control valve; and determining at least one of diver inhalation and diver exhalation comprises using at least one logic unit for determining at least one of diver inhalation and diver exhalation for each of said plurality of submerged divers, providing a pump control signal for each of said plurality of submerged divers, and operating the pump based on the pump control signals.

14. The method of claim 1, wherein operating the pump comprises providing breathable gas at a pump outlet pressure of no more than 3 psi above the highest local pressure of the plurality of divers.

15. A method of providing breathable gas to one or more submerged divers in a system comprising a pump for providing the breathable gas to the one or more submerged divers, wherein each of the one or more submerged divers is provided with a breathable gas regulator comprising an inlet and an outlet and having a regulator pressure sensor coupled thereto, a powered regulator gas control valve, and a tube coupling the breathable gas regulator to the pump, the method comprising:

for each of said one or more divers:

sensing pressure changes in the regulator associated with diver respiration using the regulator pressure sensor;

determining at least one of diver inhalation and diver exhalation based on said sensing;

operating the powered regulator gas control valve by actuating the valve to one of a plurality of open positions to allow breathable gas to flow from the pump to the breathable gas regulator during at least a portion of diver inhalation, wherein each of said plurality of open positions allows breathable gas from the pump to flow through the valve at a different flow rate, and actuating the valve to a closed position to prevent the flow of breathable gas from the pump to the breathable gas regulator during at least a portion of diver exhalation;

determining a pressure difference across the powered regulator gas control valve; and providing a pump control signal based on the pressure difference across the powered regulator gas control valve; and operating the pump based on the pump control signals for each of said one or more divers.

16. A method of providing breathable gas to a plurality of submerged divers in a system comprising a pump for providing the breathable gas to the plurality of submerged divers, wherein each of the plurality of submerged divers is provided with a breathable gas regulator comprising an inlet and an outlet and having a regulator pressure sensor coupled thereto, a powered regulator gas control valve, and a tube coupling the breathable gas regulator to the pump, the method comprising:

for each one of said plurality of divers:

sensing pressure changes in the breathable gas regulator associated with diver respiration using the regulator pressure sensor;

determining at least one of diver inhalation and diver exhalation based on said sensing;

operating the powered regulator gas control valve to allow breathable gas to flow from the pump to the breathable gas regulator during at least a portion of diver inhalation, and to prevent the flow of breathable gas from the pump to the breathable gas regulator during at least a portion of diver exhalation;

determining a pressure difference across the powered regulator gas control valve; and providing a pump control signal based on the pressure difference across the powered regulator gas control valve; and operating the pump based on the pump control signals for each of said plurality of divers, to provide breathable gas at a pump outlet pressure of no more than 5 psi above the highest local pressure of the plurality of divers, and comprising:

running the pump at a first speed when the pressure difference across any one of the powered regulator gas control valves is less than a first threshold pressure difference;

running the pump at a second speed less than the first speed when the pressure difference across all of the powered regulator gas control valves is greater than the first threshold pressure difference; and running the pump at a speed that is proportional to the difference between the pressure difference across at least one of the powered regulator gas control valves and the first threshold pressure difference.

* * * * *